US007966982B2

(12) United States Patent
Tawarada et al.

(10) Patent No.: US 7,966,982 B2
(45) Date of Patent: Jun. 28, 2011

(54) FIXATION STRUCTURE FOR VALVE SYSTEM ROTATION SHAFT OF INTERNAL COMBUSTION ENGINE

(75) Inventors: Yuichi Tawarada, Saitama (JP); Toshio Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 39 days.

(21) Appl. No.: 12/615,458

(22) Filed: Nov. 10, 2009

(65) Prior Publication Data

US 2010/0126459 A1 May 27, 2010

(30) Foreign Application Priority Data

Nov. 27, 2008 (JP) ..... 2008-302941
Jul. 22, 2009 (JP) ..... 2009-171451

(51) Int. Cl.
*F01L 1/02* (2006.01)

(52) U.S. Cl. ..... 123/90.27; 123/90.16; 123/90.38; 123/90.39; 123/90.44; 123/193.3

(58) Field of Classification Search ..... 123/90.16, 123/90.27, 90.31, 90.35, 90.38, 90.39, 90.44, 123/90.6, 193.3, 193.5
See application file for complete search history.

(56) References Cited

U.S. PATENT DOCUMENTS 7,637,236 B2 * 12/2009 Ochiai et al. ..... 123/90.33

FOREIGN PATENT DOCUMENTS

JP 2000-170506 A 6/2000

* cited by examiner

*Primary Examiner* — Ching Chang
(74) *Attorney, Agent, or Firm* — Birch, Stewart, Kolasch & Birch, LLP

(57) ABSTRACT

A fixation structure for a valve system rotation shaft of an internal combustion engine to support a camshaft with a cylinder head through the use of a lower cam holder and cam caps, which are formed separately from the cylinder head. The fixation structure eliminates the necessity of taking special vibration/noise control measures for a head cover thus preventing an increase in the cost, size, and weight of the head cover. A head external wall extends toward the head cover rather than toward a head middle surface in such a manner so as to cover the circumference of the lower cam holder fixed to a head middle surface. The connection to the holder fixation section is established with the base end of an external wall of the head cover abutted on the leading end of the head external wall.

20 Claims, 15 Drawing Sheets

FIXATION STRUCTURE FOR VALVE SYSTEM ROTATION SHAFT OF INTERNAL COMBUSTION ENGINE

CROSS-REFERENCE TO RELATED APPLICATIONS

The present application claims priority under 35 USC 119 to Japanese Patent Application No. 2008-302941 filed on Nov. 27, 2008 and Japanese Patent Application No. 2009-171451 filed on Jul. 22, 2009 the entire contents of which are hereby incorporated by reference.

BACKGROUND OF THE INVENTION

1. Field of the Invention

The present invention relates to a fixation structure for a valve system rotation shaft of an internal combustion engine.

2. Description of Background Art

A fixation structure for a valve system rotation shaft for an internal combustion engine is disclosed, for instance, in JP-A No. 2000-170506. This fixation structure rotatably fixes a camshaft for driving an engine valve mounted within a cylinder head of the internal combustion engine. The engine valve is mounted relative to the cylinder head through the use of a lower cam holder and a cam cap wherein the lower cam holder is fixed and is formed separately from the cylinder head. A holder fixation section for securing the lower cam holder and a cover connection section for connecting a base end of an external wall of a head cover at the peripheral side of the holder fixation section are positioned substantially flush with each other and mounted on the side toward the head cover of the cylinder head. The lower cam holder is mounted so that it is projected from the holder fixation section and cover connection section toward the head cover. Further, the external wall of the head cover extends toward the cylinder head in such a manner so as to cover the circumference of the lower cam holder.

However, when the external wall of the head cover is extended to increase its depth as in the above related-art configuration, the head cover is likely to vibrate, thereby causing resonance. Therefore, it is necessary to assure adequate rigidity by increasing the thickness or providing an additional reinforcement or take other vibration/noise control measures. This is likely to increase the cost, size, and weight of the head cover. Further, the use of the related-art configuration increases the depth of the head cover. Therefore, if there is no unoccupied space above the head cover, the head cover cannot be removed or reinstalled with the engine mounted in a vehicle. This situation is disadvantageous in that the engine needs to be demounted when, for instance, light-duty maintenance tasks such as tappet clearance adjustments are to be performed.

SUMMARY AND OBJECTS OF THE INVENTION

The present invention has been made in view of the above circumstances. An object of an embodiment of the present invention to provide a fixation structure for a valve system rotation shaft of an internal combustion engine, which supports a camshaft with a cylinder head by using a cam cap and a lower cam holder formed separately from the cylinder head, while eliminating the necessity of taking special vibration/noise control measures for a head cover and preventing an increase in the cost, size, and weight of the head cover.

In accomplishing the above object, according to an embodiment of the invention there is provided a fixation structure for a valve system rotation shaft of an internal combustion engine. The fixation structure rotatably fixes camshafts 11, 12 for driving an engine valve 6 and an exhaust valve 7 mounted on a cylinder head 2 of the internal combustion engine 1 to the cylinder head through the use of a lower cam holder 41 and cam caps 51, 61, 71. The fixation structure also fixes the lower cam holder, which is formed separately from the cylinder head, to the cylinder head. The cylinder head includes a holder fixation section 105 for securing the lower cam holder and a cover connection section e.g., a head external wall 106 for connecting a base end of an external wall 3*a* of a head cover 3 at the peripheral side of the holder fixation section. The cover connection section extends toward the head cover rather than toward the holder fixation section in such a manner so as to cover the circumference of the lower cam holder fixed to the holder fixation section. The connection to the holder fixation section is established with the base end of the external wall of the head cover abutting on a leading end of the cover connection section.

According to an embodiment of the present invention, the central axis lines C3, C4 of the camshaft are positioned on a joint surface 107 between the lower cam holder and the cam cap, and the joint surface is substantially flush with a joint surface 108 between the cover connection section and the external wall of the head cover.

According to an embodiment of the present invention, the lower cam holder is fastened to the cylinder head together with the cam cap through the use of a fastener e.g., a bolt B1 shared by the lower cam holder and the cam cap.

According to an embodiment of the present invention, the lower cam holder is provided with support holes 14*a*, 18*a* for supporting a rocker arm shaft 14, 18, which swingably supports rocker arms 13, 17 swung by the camshaft. The cover connection section extends upwardly beyond the support hole.

According to an embodiment of the present invention, the lower cam holder includes at least a part of a secondary air supply path 112 between a secondary air supply valve e.g., reed valve 114 mounted on the head cover and an exhaust port 9 of the cylinder head.

According to an embodiment of the present invention, the internal combustion engine is a parallel multicylinder engine, and the lower cam holder is formed by coupling lower cam holder sections e.g., first to fifth intake lower cam holder sections 44*a* to 44*e* and first to fifth exhaust lower cam holder sections 45*a* to 45*e* of neighboring cylinders in an integrated manner.

According to an embodiment of the present invention, an actuator e.g., a hydraulic actuator 85 for driving the valve system 5 is installed to straddle the cover connection section of the cylinder head and is positioned between a head cover side end e.g., a joint surface 108 of the cover connection section of the cylinder head and a cylinder side end e.g., a joint surface 109 forming a mating surface to be connected to a cylinder block 2*a* of the cylinder head.

According to an embodiment of the present invention, the connection to the holder fixation section for securing the lower cam holder, which is separate from the cylinder head, is established by extending the cover connection section for head cover fixation toward the head cover and abutting the base end of the external wall of the head cover on the leading end of the cover connection section. This makes it possible to eliminate the necessity of extending the external wall of the head cover, minimize the depth of the head cover, and cover the circumferences, for instance, of the lower cam holder, which is fixed to the holder fixation section, and of the cam cap, which is fixed to the lower cam holder. Consequently, it is possible to eliminate the necessity of taking special vibration/noise control measures for the head cover, such as increasing its thickness and providing an additional reinforcement, and prevent an increase in the cost, size, and weight of the head cover. Further, as the depth of the head cover is decreased, the head cover can be removed and reinstalled for maintenance purposes even when the engine is mounted in the vehicle. This provides improved maintainability.

According to an embodiment of the present invention, the joint surfaces are substantially flush with each other. Therefore, when the camshaft is to be installed, it is easy to verify that the camshaft is properly set on the lower cam holder. This provides improved camshaft assembly workability.

According to an embodiment of the present invention, it is possible to avoid the use of a fastener for fastening the lower cam holder only. This makes it possible to reduce the cost and weight.

According to an embodiment of the present invention, if the rocker arm shaft is supported by the support hole in the lower cam holder, the rocker arm shaft and rocker arm can be mounted on the cylinder head while they are attached to the lower cam holder, even if the employed configuration is such that the rocker arm shaft is positioned below the leading end of the cover connection section. Consequently, the rocker arm shaft can be positioned in a space below a camshaft support position without sacrificing rocker arm assembly workability. This makes it possible to minimize the height of the cylinder head.

According to an embodiment of the present invention, the lower cam holder can be used to provide the secondary air supply path. This makes it possible to reduce the cost and weight by reducing the number of dedicated parts.

According to an embodiment of the present invention, the lower cam holder sections for a plurality of cylinders can be formed in an integrated manner. This provides improved productivity and assembly workability.

According to an embodiment of the present invention, when the actuator for driving the valve system is installed to straddle the cover connection section which extends toward the head cover, even the engine having the actuator can provide the cylinder head with an adequate space for actuator installation. When, as in a previous case, a deep head cover is formed with a small cylinder head side portion, it was difficult to provide the cylinder head side portion with a space for an actuator installation so that the actuator had to be installed on the head cover side or installed to straddle the cylinder block or crankcase. However, when the actuator is installed to straddle the cover connection section which extends toward the head cover, the above-described configuration makes it possible to position the actuator near the valve system to be driven, thereby improving the operability and response of the valve system.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3(*b*) is a plan view illustrating a situation where the rocker arm is in a second operating position;

FIG. 4(*b*) is a cross-sectional view that is taken in the axial direction of the rocker arm shaft to illustrate a situation where the rocker arm is in the second operating position;

DETAILED DESCRIPTION OF THE PREFERRED EMBODIMENTS

An embodiment of the present invention will now be described with reference to the accompanying drawings. For convenience of explanation, arrows FR, LH, and UP indicate a forward direction, a leftward direction, and an upward direction, respectively.

Figure 1:
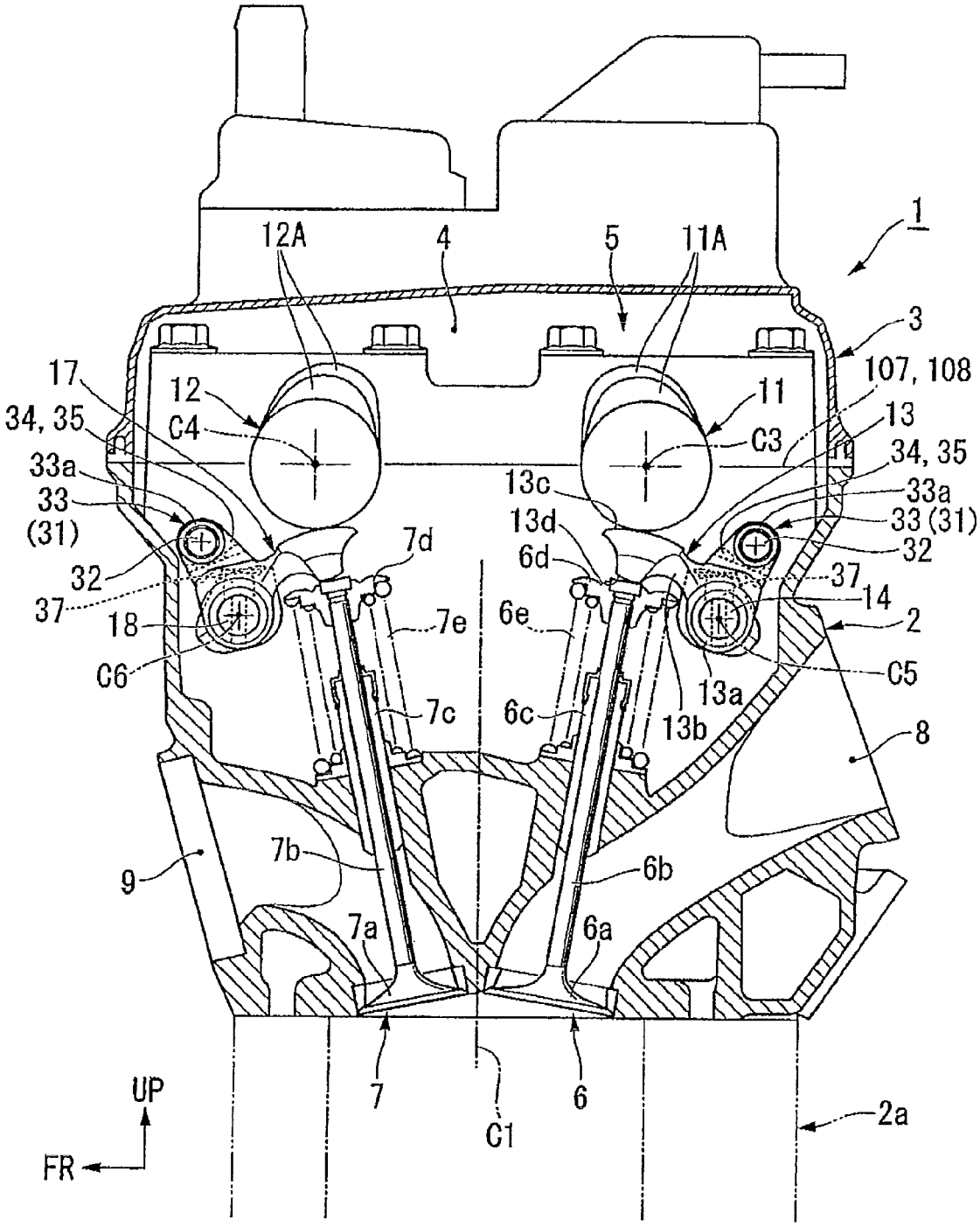
FIG. 1 is a left side view illustrating a cylinder head section of an engine according to an embodiment of the present invention.

FIG. 1 is a left side view illustrating a cylinder head 2 of a four-stroke DOHC parallel four-cylinder engine 1, which is used for a motor in a motorcycle or other vehicle. A head cover 3 is installed over the cylinder head 2 (leading end). A valve chamber 4, which is formed by the cylinder head 2 and head cover 3, houses a valve device 5 for driving an intake valve 6 and an exhaust valve 7. As illustrated in FIG. 1, a central axis line C1 of a cylinder bore (cylinder axis line) in a cylinder body 2*a*, is joined to the underside of the cylinder head 2 (the side toward the base end).

Intake and exhaust ports 8, 9 for each cylinder are formed in the front or rear of the cylinder head 2. The intake and exhaust ports 8, 9 form a pair of combustion chamber side openings. The combustion chamber side openings are individually opened and closed by a pair of intake and exhaust valves 6, 7. In other words, the engine 1 is of a four-valve type so that each cylinder is provided with right-hand and left-hand pairs of intake and exhaust valves 6, 7.

The intake and exhaust valves 6, 7 are configured so that rod-shaped stems 6*b*, 7*b* extend towards the valve chamber 4 from umbrella-shaped valve discs 6*a*, 7*a*, which are respectively aligned with the combustion chamber side openings. The stems 6*b*, 7*b* of the intake and exhaust valves 6, 7 are reciprocatably retained by the cylinder head 2 via valve guides 6*c*, 7*c*, respectively. Retainers 6*d*, 7*d* are attached to the valve chamber 4 side leading ends of the stems 6*b*, 7*b*. Valve springs 6*e*, 7*e* are installed in a compressed state between the retainers 6*d*, 7*d* and the cylinder head 2.

The force of the valve springs 6*e*, 7*e* pushes the intake and exhaust valves 6, 7 upward, thereby causing their valve discs 6*a*, 7*a* to close the combustion chamber side openings. On the other hand, when the intake and exhaust valves 6, 7 are allowed to stroke downward against the force of the valve springs 6*e*, 7*e*, the valve discs 6*a*, 7*a* of the intake and exhaust valves 6, 7 leave the combustion chamber side openings to open them.

The stems 6*b*, 7*b* of the intake and exhaust valves 6, 7 are installed so that they are inclined from the cylinder axis line C1 to form the letter "V" when viewed laterally. An intake camshaft 11 and an exhaust camshaft 12, which are oriented in a left-right direction, are positioned above the stems 6*b*, 7*b*, respectively.

Figure 5:
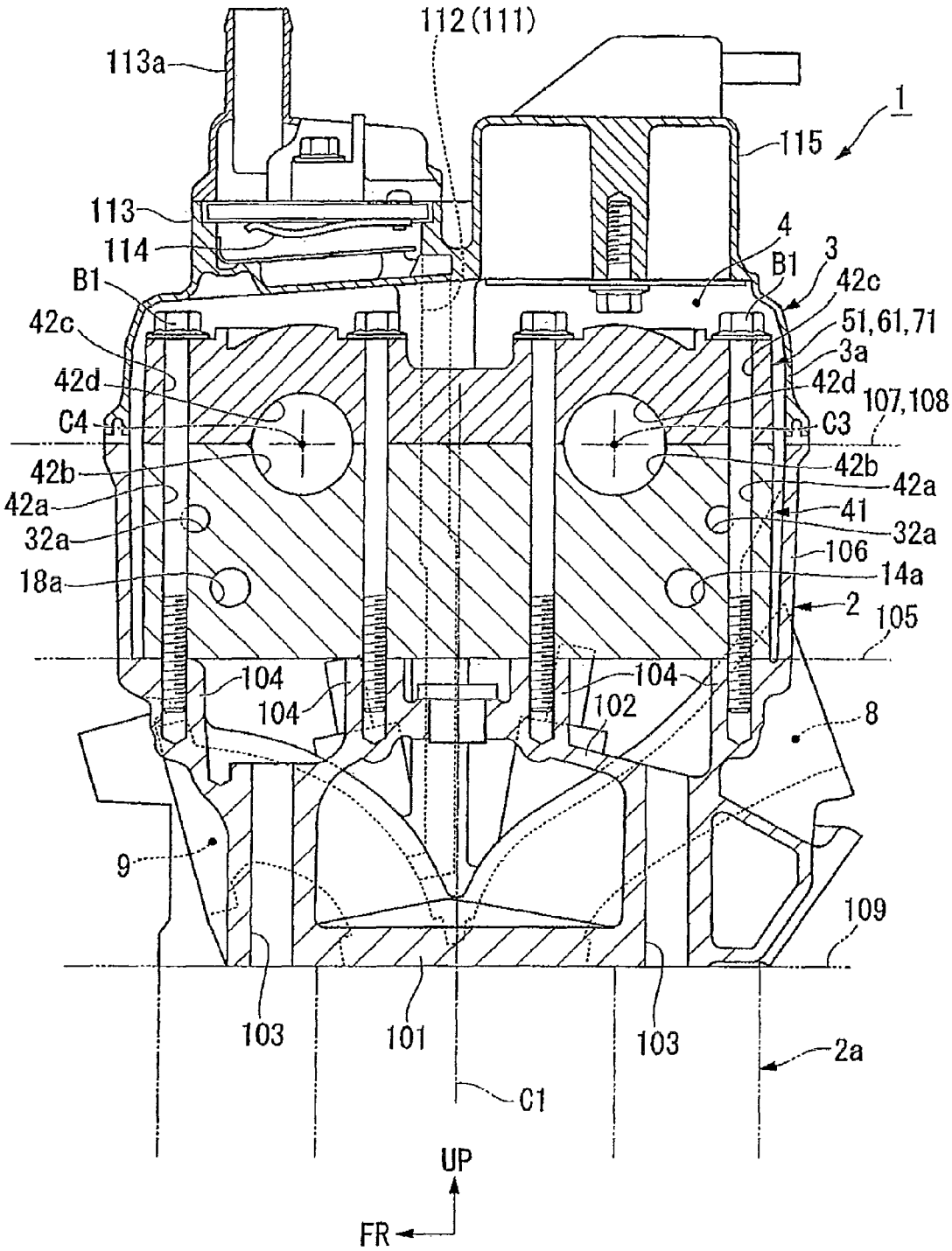
FIG. 5 is an inter-cylinder cross-sectional view illustrating the cylinder head section.
Figure 6:
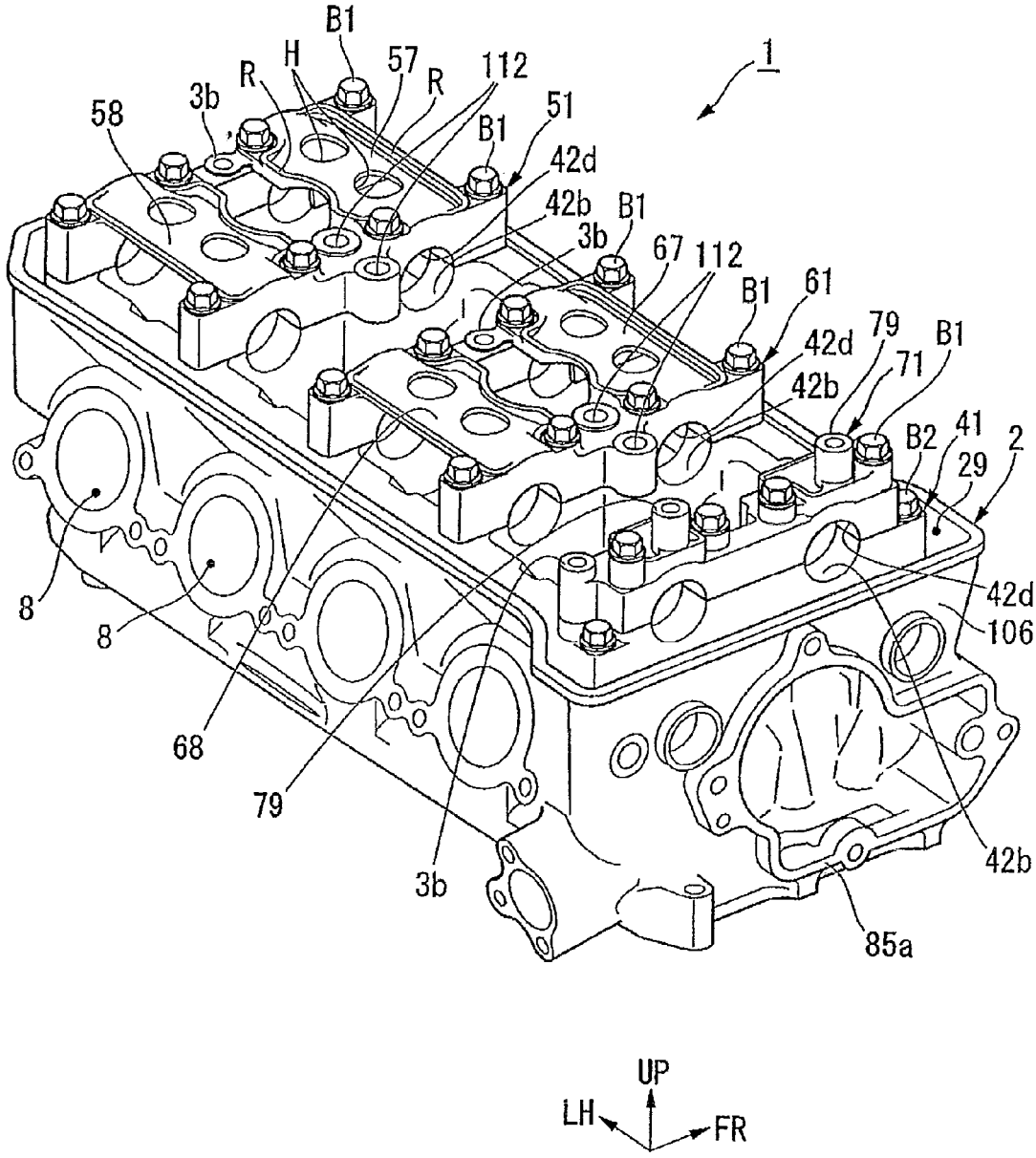
FIG. 6 is a perspective view illustrating a cylinder head.
Figure 7:
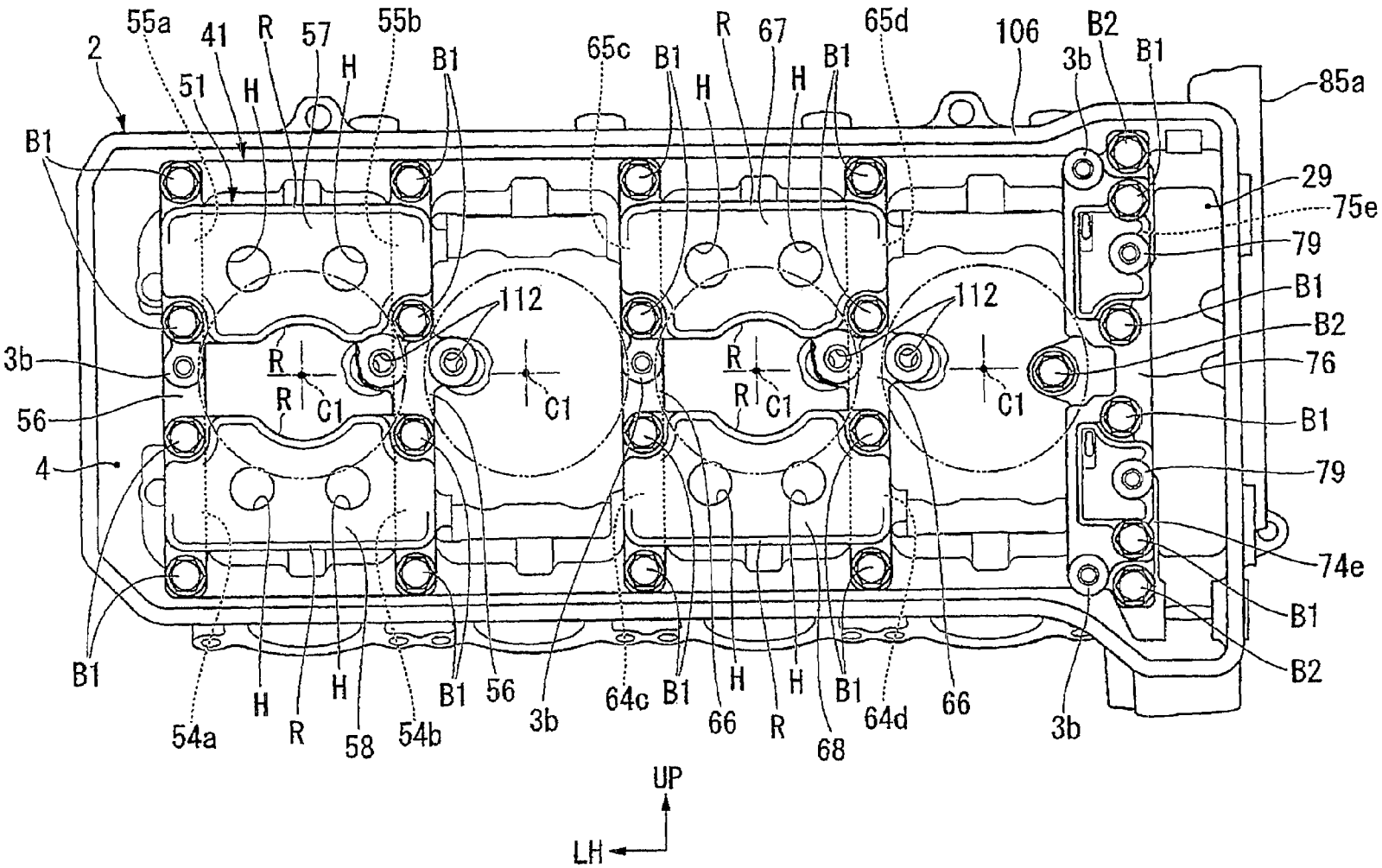
FIG. 7 is a top view illustrating the cylinder head.

Referring to FIGS. 5 to 7, the camshafts 11, 12 are supported by a lower cam holder 41 and a plurality of cam caps 51, 61, 71 in such a manner that the camshafts 11, 12 can rotate around their axes. The lower cam holder 41 and the cam caps 51, 61, 71 are formed separately from the cylinder head 2. They are fastened to the cylinder head 2 in an integrated manner while they are placed on the cylinder head 2. Further, the head cover 3 is placed over the cylinder head 2. The head cover 3 is fastened to the cam caps 51, 61, 71 and to the cylinder head 2 in an integrated manner while it covers, for instance, the lower cam holder 41 and cam caps 51, 61, 71.

Figure 13:
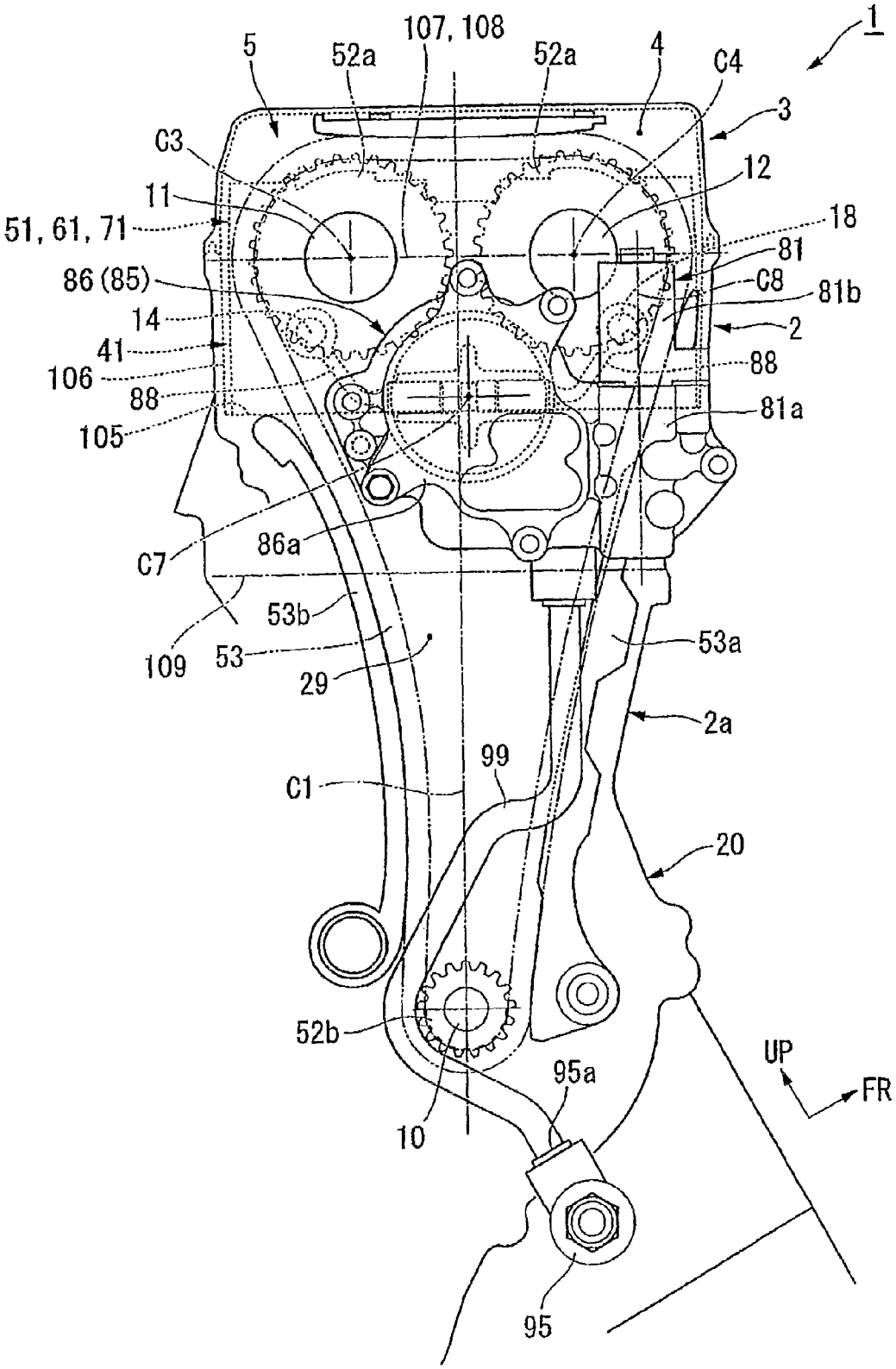
FIG. 13 is a right side view illustrating a cylinder section of the engine having the hydraulic actuator.

The camshafts 11, 12 are rotationally driven via a chain-type transmission mechanism or the like in synchronism with a crankshaft 10 (see FIG. 13). Rotational central axis lines C3 and C4 (cam axis lines) of the camshafts 11, 12 are provided together with a cam chain chamber 29, which is formed in the right-hand section of the cylinder head 2 to house the chain-type transmission mechanism.

Figure 2:
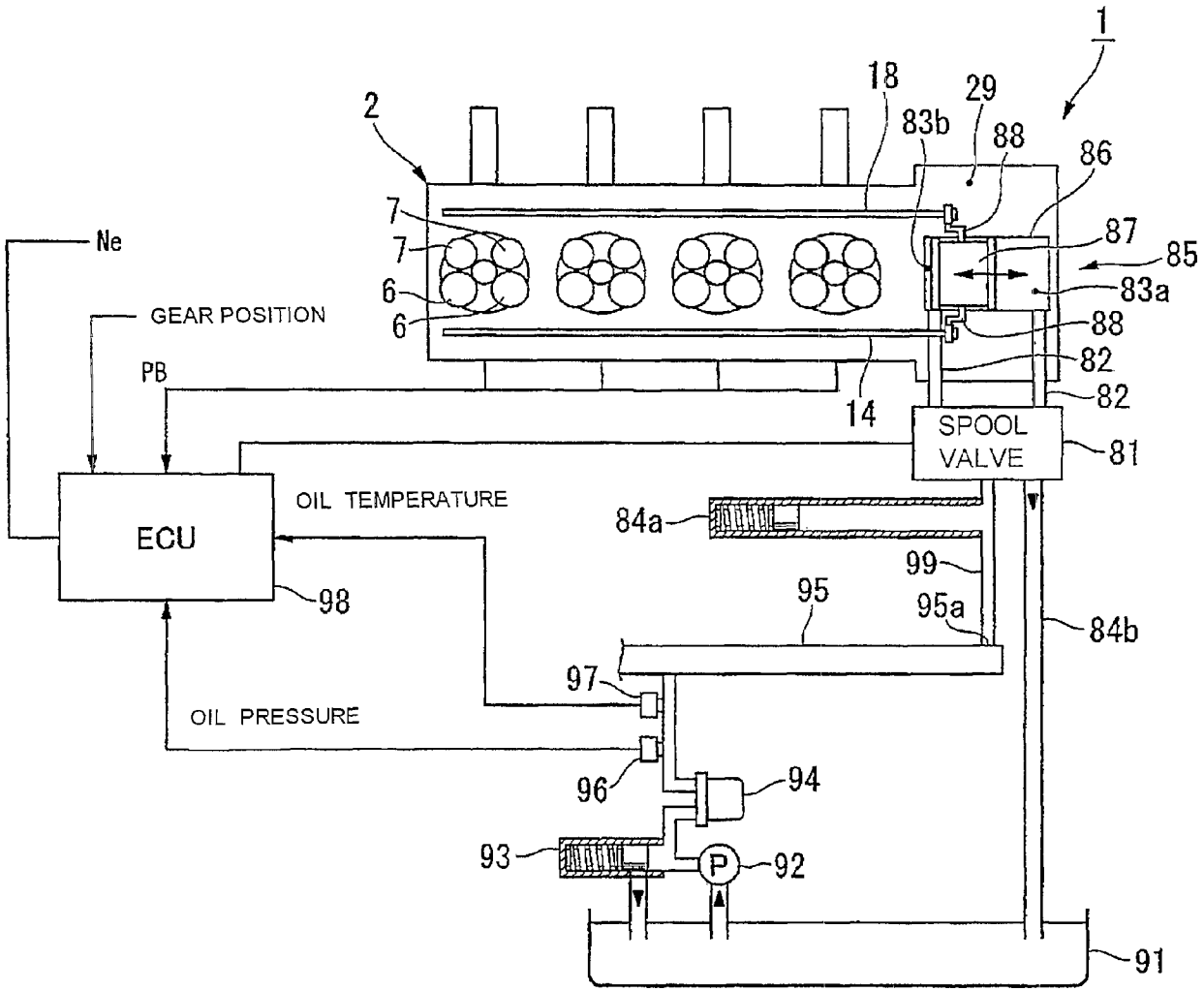
FIG. 2 is a diagram illustrating a variable valve device for the engine.
Figure 3A:
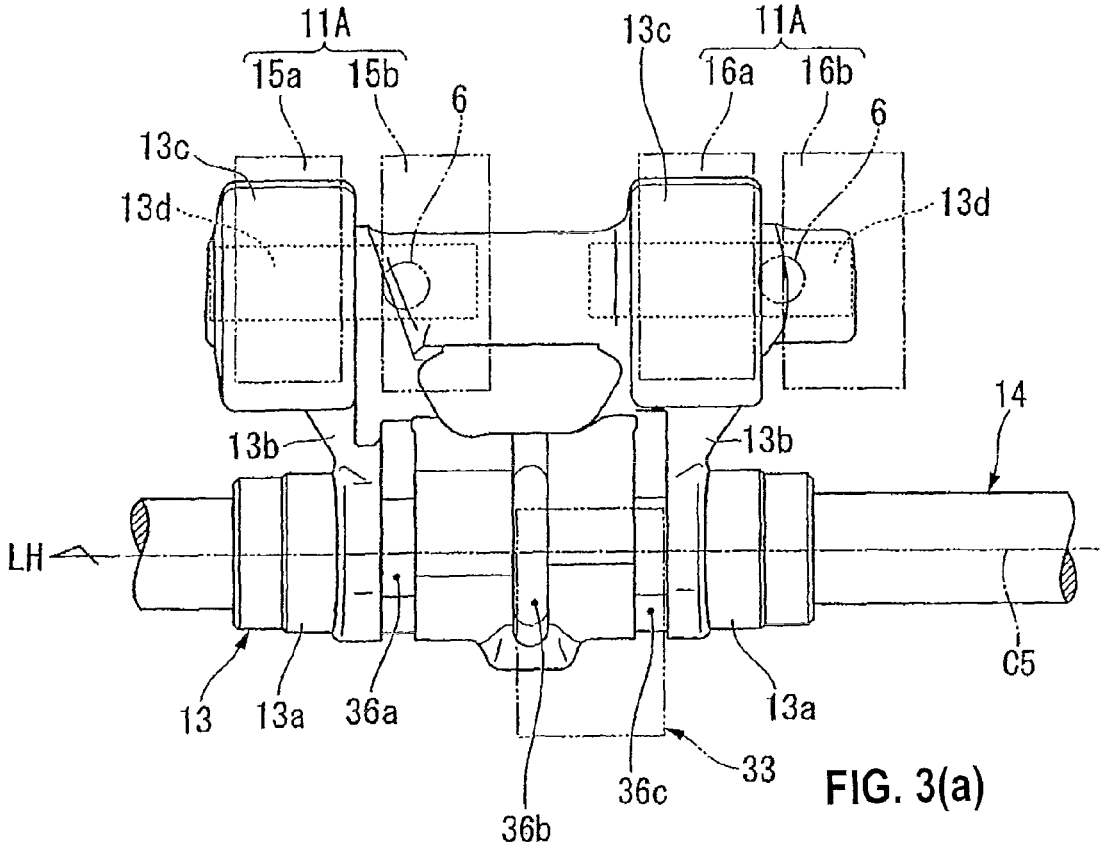
FIG. 3(*a*) is a plan view illustrating a situation where an intake rocker arm of the engine is in a first operating position.
Figure 3B:
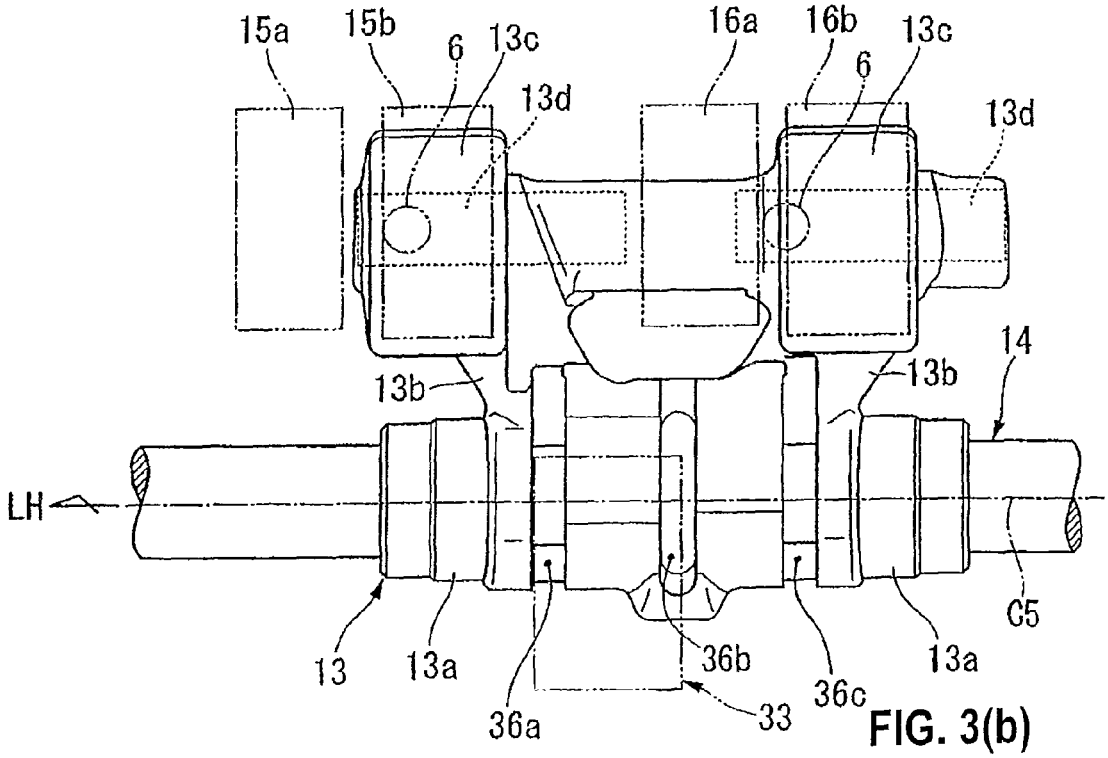

Referring to FIGS. 1 to 3, a pair of right-hand and left-hand intake valves 6 for each cylinder open or close when they are pressed by cams 11A of the intake camshaft 11 via an intake rocker arm 13 for each cylinder. Similarly, a pair of right-hand and left-hand exhaust valves 7 for each cylinder open or close when they are pressed by a cam 12A of the exhaust camshaft 12 via an exhaust rocker arm 17 for each cylinder.

The intake rocker arm 13 is supported by an intake rocker arm shaft 14, which is positioned in parallel with the intake camshaft 11 and in the rear of the leading end of the stem 6*b* of the intake valve 6, in such a manner that the intake rocker arm 13 can swing about the shaft and slide in an axial direction. Similarly, the exhaust rocker arm 17 is supported by an exhaust rocker arm shaft 18, which is positioned in parallel with the exhaust camshaft 12 and in front of the leading end of the stem 7*b* of the exhaust valve 7, in such a manner that the exhaust rocker arm 17 can swing about the shaft and slide in an axial direction. Central axis lines C5 and C6 (rocker axis lines) are provided of the rocker arm shafts 14, 18.

An arm section 13*b* extends toward the leading end of the stem 6*b* of the intake valve 6 from a cylindrical base (shaft insertion boss) 13*a* into which the intake rocker arm shaft 14 for the intake rocker arm 13 is inserted. The upper side of the leading end of the arm section 13*b* is provided with a cam slide contact section 13*c* so that the cams 11A of the intake camshaft 11 slidingly contact the cam slide contact section 13*c*. The lower side of the leading end of the arm section 13*b* is provided with a valve pressure section 13*d*, which abuts on the leading end of the stem 6*b* and presses it downwardly. The exhaust rocker arm 17 has the same configuration as described above.

When the engine 1 operates, the camshafts 11, 12 are rotationally driven in synchronism with the crankshaft 11 to swing the rocker arms 13, 17 as needed in accordance with the peripheral patterns of the cams 11A, 12A. The rocker arms 13, 17 then press the intake and exhaust valves 6, 7 to reciprocate them as needed, thereby opening and closing the combustion chamber side openings of the intake and exhaust ports 8, 9.

The valve device 5 is configured as a variable valve device that is capable of changing the opening/closing timings and lift amounts of the valves 6, 7. In a low-speed rotation region where, for instance, the engine speed is lower than 6,000 rpm (revolutions per minute), the valve device 5 opens and closes the valves 6, 7 by using low-speed rotation cams of the camshafts 11, 12. In a high-speed rotation region where the engine speed is 6,000 rpm or higher, the valve device 5 opens and closes the valves 6, 7 by using high-speed rotation cams of the camshafts 11, 12.

As an example, the intake configuration of the valve device 5 for one cylinder will now be described. It should be noted, however, that the intake configurations of the other cylinders and the exhaust configurations of all cylinders are the same as described below.

Referring to FIGS. 1 and 3, the cams 11A of the camshaft 11 are composed of left-hand and right-hand first cams 15*a*, 16*a* for the low-speed rotation region and left-hand and right-hand second cams 15*b*, 16*b* for the high-speed rotation region. In other words, the camshaft 11 has a total of four cams (left-hand and right-hand first cams 15*a*, 16*a* and left-hand and right-hand second cams 15*b*, 16*b*) per cylinder.

The left-hand and right-hand first cams 15*a*, 16*a* are of the same shape, and the left-hand and right-hand second cams 15*b*, 16*b* are of the same shape. The left-hand first cam 15*a* and the left-hand second cam 15*b* are positioned on the left-hand side of a cylinder and adjacent to each other in a left-right direction (in the direction of the cam axis). The right-hand first cam 16*a* and the right-hand second cam 16*b* are positioned on the right-hand side of a cylinder and adjacent to each other in a left-right direction (in the direction of the cam axis).

The rocker arm 13 is supported by the rocker arm shaft 14 in such a manner that the rocker arm 13 can swing about the shaft (about the center of the rocker axis line C5 or it may be hereinafter referred to as "about axis C5") and move in an axial direction (in the direction along the rocker axis line C5 or it may be hereinafter referred to as "in the direction of axis C5"). The rocker arm 13 is a wide single piece that extends in a left-right direction between the left-hand and right-hand intake valves 6. The cam slide contact section 13*c* and valve pressure section 13*d* of the rocker arm 13 are disposed apart from each other in a left-right direction to form a pair.

When the engine 1 is stopped or operating in the low-speed rotation region, the rocker arm 13 is positioned at the limit of leftward movement in the direction of axis C5 (see FIG. 3(*a*)). In this state, the left-hand and right-hand cam slide contact sections 13*c* of the rocker arm 13 are positioned below the left-hand and right-hand first cams 15*a*, 16*a*, respectively, and can slidingly contact the peripheral surfaces of the cams (cam surfaces). The left-hand and right-hand valve pressure sections 13*d* of the rocker arm 13 are wider than the left-hand and right-hand cam slide contact sections 13*c* in a left-right direction (in the direction of axis C5). When the rocker arm 13 is positioned at the limit of leftward movement, the left-hand and right-hand valve pressure sections 13*d* of the rocker arm 13 are positioned so that the right-hand sides of the left-hand and right-hand valve pressure sections 13*d* can press the leading ends of the stems 6*b* of the left-hand and right-hand intake valves 6. The resulting position of the rocker arm 13 in the direction of axis C5 is referred to as the first operating position.

When, on the other hand, the engine 1 is operating in the high-speed rotation region, the rocker arm 13 is positioned at the limit of the rightward movement in the direction of axis C5 (see FIG. 3(*b*)). In this state, the left-hand and right-hand cam slide contact sections 13*c* of the rocker arm 13 are positioned below the left-hand and right-hand second cams 15*b*, 16*b*, respectively, and can slidingly contact the peripheral surfaces of the cams (cam surfaces). When the rocker arm 13 is positioned at the limit of rightward movement, the left-hand and right-hand valve pressure sections 13*d* of the rocker arm 13 are positioned so that the left-hand sides of the left-hand and right-hand valve pressure sections 13*d* can press the leading ends of the stems 6*b* of the left-hand and right-hand intake valves 6. The resulting position of the rocker arm 13 in the direction of axis C5 is referred to as the second operating position.

When the rocker arm 13 is in the first operating position, the rocker arm 13 swings in accordance with the peripheral patterns of the left-hand and right-hand first cams 15*a*, 16*a* to open and close the intake valves 6. When, on the other hand, the rocker arm 13 is in the second operating position, the rocker arm 13 swings in accordance with the peripheral patterns of the left-hand and right-hand second cams 15*b*, 16*b* to open and close the intake valves 6.

Figure 4A:
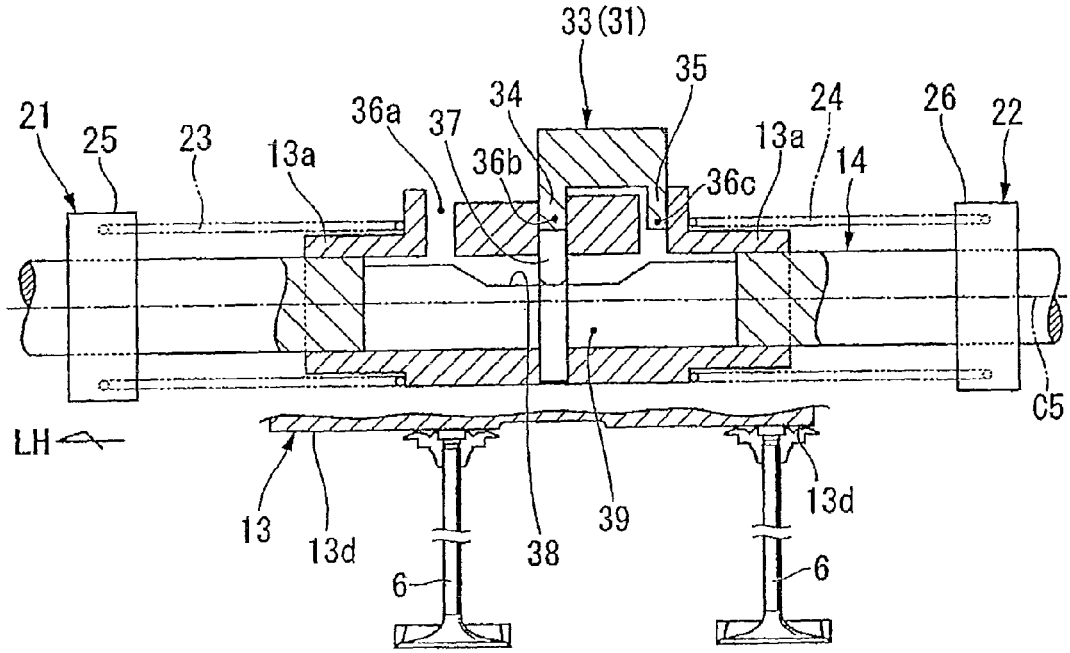
FIG. 4(*a*) is a cross-sectional view that is taken in the axial direction of a rocker arm shaft to illustrate a situation where the rocker arm is in the first operating position.
Figure 4B:
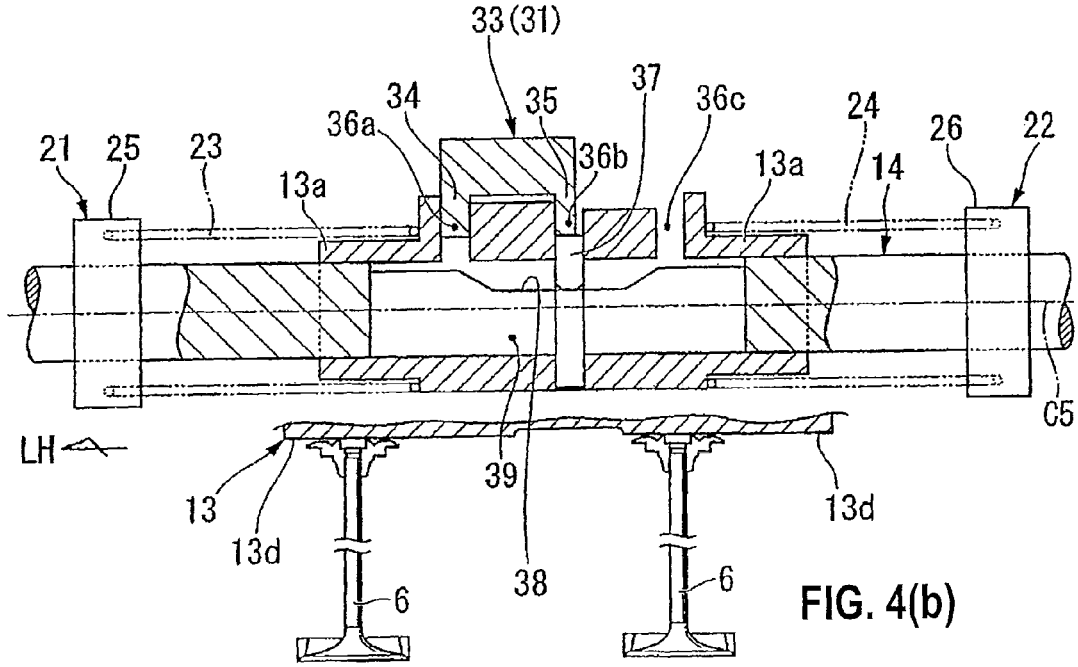

Referring to FIGS. 4(*a*) and 4(*b*), the valve device 5 stores the force for causing first and second rocker arm movement mechanisms 21, 22 to move the rocker arm 13 in the direction of axis C5 in accordance with the engine speed. The stored force is used to move the rocker arm 13 to either the first operating position or the second operating position. This makes it possible to open and close the intake valves 6 by selectively using either the left-hand and right-hand first cams 15*a*, 16*a* or the left-hand and right-hand second cams 15*b*, 16*b*.

The first rocker arm movement mechanism 21 includes a first spring 23 and a first spring receiving collar 25. The first spring 23 is positioned to the left of the shaft insertion boss 13*a* of the rocker arm 13, and applies a force to the leftmost end of the shaft insertion boss 13*a* in a direction from the first operating position side (low-speed rotation side) to the second operating position side (high-speed rotation side). The first spring receiving collar 25 is positioned to the left of the first spring 23 and fixedly supported by the periphery of the rocker arm shaft 14.

Similarly, the second rocker arm movement mechanism 22 includes a second spring 24 and a second spring receiving collar 26. The second spring 24 is positioned to the right of the shaft insertion boss 13*a* of the rocker arm 13, and applies a force to the rightmost end of the shaft insertion boss 13*a* in a direction from the second operating position side to the first operating position side. The second spring receiving collar 26 is positioned to the right of the second spring 24 and is fixedly supported by the periphery of the rocker arm shaft 14.

The rocker arm shaft 14 is supported by the cylinder head 2 in such a manner that the rocker arm shaft 14 can move in the direction of its axis. The rocker arm shaft 14 stores a force that moves the rocker arm 13 to either the first rocker arm movement mechanism 21 or the second rocker arm movement mechanism 22 when the rocker arm shaft 14 moves in the axial direction in accordance with an operation performed by a hydraulic actuator 85 (see FIGS. 2, 13, and 14), which is positioned at the right-hand side of the cylinder head 2.

When the engine 1 is stopped or operating within the low-speed rotation region (is in a low-speed operational state), the rocker arm shaft 14 and the spring receiver collars 25, 26 are positioned at the limit of leftward movement in their respective axial direction (see FIG. 4(*a*)). In this state, the rocker arm 13 is in the first operating position so that the springs 23, 24 are subjected to predefined initial compression and positioned between the shaft insertion boss 13*a* of the rocker arm 13 and the spring receiving collars 25, 26, respectively.

On the other hand, when the engine 1 is operating within the high-speed rotation region (is in a high-speed operational state), the rocker arm shaft 14 and the spring receiver collars 25, 26 are positioned at the limit of rightward movement in their respective axial direction (see FIG. 4(*b*)). In this state, the rocker arm 13 is in the second operating position so that the springs 23, 24 are subjected to predefined initial compression as described above and positioned between the shaft insertion boss 13*a* of the rocker arm 13 and the spring receiving collars 25, 26, respectively.

When the rocker arm 13 is to be moved from one operating position to another, the rocker arm shaft 14 and the spring receiving collars 25, 26 are integrally moved in the direction of axis C5 toward the cylinder head 2 to cause a predefined elastic force difference between the springs 23, 24 while a trigger arm 33 of a movement restriction mechanism 31 is used to restrict the movement of the rocker arm 13 in the direction of axis C5. The elastic force difference (the elastic force stored by either the spring 23 or the spring 24) is then used to move the rocker arm 13 from one operating position to another.

Referring to FIGS. 1 and 4, the movement restriction mechanism 31 is mainly composed of the trigger arm 33, three engagement grooves 36*a*, 36*b*, 36*c* arranged in a left-right direction, and a trigger pin 37. The trigger arm 33 is supported by the cylinder head 2 via a support shaft 32, which is parallel to the rocker arm shaft 14, in such a manner that the trigger arm 33 can swing about the support shaft 32 but cannot move in the axial direction. The engagement grooves 36*a*, 36*b*, 36*c* are formed in the shaft insertion boss 13*a* of the rocker arm 13 in order to be selectively engaged with a pair of left-hand and right-hand engagement claws 34, 35 of the trigger arm 33. The trigger pin 37 vertically passes through the shaft insertion boss 13*a* of the rocker arm 13 and the rocker arm shaft 14 in a direction orthogonal to the direction of axis C5 (in the axis C5 orthogonal direction).

When installed, the support shaft 32 of the trigger arm 33 is shifted upward from the rocker arm shaft 14 and outward from the cylinder (away from the cylinder axis line C1).

The trigger arm 33 is configured so that the left-hand and right-hand engagement claws 34, 35 extend from a cylindrical base 33*a*, into which the support shaft 32 is inserted, toward the rocker arm shaft 14.

When the rocker arm 13 is in either of the two different operating positions, the trigger arm 33 engages the left-hand and right-hand engagement claws 34, 35 with appropriate ones of the engagement grooves 36*a*, 36*b*, 36*c* to prevent the rocker arm 13 from sliding in the direction of axis C5. In the other situation, the trigger arm 33 swings away from the rocker arm 13 (in the direction of moving away from the rocker arm 13) to disengage the left-hand and right-hand engagement claws 34, 35 from the engagement grooves 36*a*, 36*b*, 36*c*, thereby allowing the rocker arm 13 to slide in the direction of axis C5.

The upper periphery of a portion of the rocker arm shaft 14 that is inserted into the shaft insertion boss 13*a* is provided with a cut concave 38, which extends over a predetermined distance in the direction of axis C5. Further, the rocker arm shaft 14 is provided with a slit-shaped through-hole 39, which vertically runs through the rocker arm shaft 14 in the axis C5 orthogonal direction and is elongated in the direction of axis C5, extends in the direction of axis C5 over a longer distance than the cut concave 38. The trigger pin 37 is inserted downward into the through-hole 39 and retained so as to permit movement in the direction of axis C5.

When the hydraulic actuator 85 operates to move the rocker arm shaft 14 in the direction of axis C5 while the movement restriction mechanism 31 inhibits the rocker arm 13 from moving in the direction of axis C5 in a state where the rocker arm 13 is in either of the two different operating positions, the trigger arm 33 coordinates with the cut concave 38 and moves upward in the axis C5 orthogonal direction. The trigger pin 37 then moves into the central engagement groove 36*b* in response to a sliding motion of the rocker arm shaft 14.

Either of the left-hand and right-hand engagement claws 34, 35 of the trigger arm 33 is moved downward to engage with the central engagement groove 36*b*. When the trigger pin 37 moves upward in this state, the trigger arm 33 swings by a predetermined amount in the direction of releasing the engagement with the central engagement grove 36*b* and with the rocker arm 13. As the rocker arm 13 swings subsequently, the trigger arm 33 disengages from the rocker arm 13 in synchronism with the swing of the rocker arm 13, thereby allowing the rocker arm 13 to move from one operating position to another.

Referring to FIGS. 2, 6, 13, and 14 the right-hand side of the cylinder head 2 is provided with the hydraulic actuator 85, which moves the rocker arm shafts 14, 18 in the direction of axis C5. As illustrated in FIG. 6, a mount 85*a* is provided for the hydraulic actuator 85, which is formed on the right-hand side of the cylinder head 2.

Referring to FIG. 2, the hydraulic actuator 85 is configured so that a hydraulic cylinder 86 whose axial direction is parallel to that of the rocker arm shafts 14, 18 is positioned so as to transversely cross the cam chain chamber 29 in the right-hand portion of the cylinder head 2 between the rocker arm shafts 14, 18. A pair of front and rear operating elements 88 are attached to both lateral surfaces of a plunger 87 in the hydraulic cylinder 86 (see FIGS. 13 and 15). The operating elements 88 respectively engage with the rightmost ends of the rocker arm shafts 14, 18 so that the rocker arm shafts 14, 18 simultaneously move in the direction of axis C5 in accordance with a stroke of the plunger 87.

An oil pump 92 is positioned below the engine 1 to pump engine oil that is stored in an oil pan 91. The engine oil pumped from the oil pump 92 is supplied to an oil gallery 95 through a relief valve 93 and an oil filter 94. Further, the oil gallery 95 supplies the engine oil mainly to various parts in a crankcase 20 (see FIGS. 13 and 14) and the cylinder head 2.

The oil gallery 95 is positioned substantially directly below the crankshaft 10 and extends in the direction of cylinder arrangement (in the left-right direction) (see FIG. 13). An oil path between the oil pump 92 and oil gallery 95 is provided with an oil pressure sensor 96 and an oil temperature sensor 97. Detection signals generated from the sensors 96, 97 enter an ECU 98, which control the overall operation of the engine 1.

An oil supply hole 95*a* is made in the rightmost end of the oil gallery 95. An oil path 99 extends from the oil supply hole 95*a* to a spool valve 81 of the hydraulic actuator 85. The ECU 98 controls the operation of the spool valve 81 to select a hydraulic path in accordance, for instance, with the engine speed (Ne) and gear position, thereby changing the cam for opening and closing the valves 6, 7.

The spool valve 81 permits the oil pressure supplied from the oil path 99 to be selectively applied to oil chambers 83*a*, 83*b* on both sides of the hydraulic cylinder 86 through two coupling oil paths 82. When the oil pressure from the oil pump 92 is selectively applied to the oil chambers 83*a*, 83*b* on both sides of the hydraulic cylinder 86 through the spool valve 81, the plunger 87 strokes to simultaneously move the rocker arm shafts 14, 18 in an axial direction. An accumulator 84*a* is provided that is positioned in the oil path 99. An oil pressure return path 84*b* extends from the spool valve 81. For failure detection purposes, the ECU 98 inputs information about detected intake pipe internal negative pressure (PB) of each cylinder.

Referring to FIG. 5, a hollow space between a roof formation section 101, which forms a ceiling of a combustion chamber below the cylinder head 2, and a middle wall 102, which is positioned above the roof formation section 101, is used as a cooling water distribution path. The cylinder head 2 has a plurality of bolt insertion holes 103, which are formed to match a plurality of stud bolts (not shown) that are erected on the crankcase 20 (not shown). The stud bolts or the like inserted into the bolt insertion holes 103 are used to fasten the cylinder head 2 and cylinder body 2*a*, as an assembly, to the crankcase 20. A joint surface 109 (mating surface) of the cylinder head 2 (the lower end face of the cylinder head 2) is provided that mates with the cylinder body 2*a*.

A plurality of bosses 104 having a screw hole, which is open upward, protrude from the middle wall 102. The upper end face of each boss 104 forms a planar head middle surface 105, which is orthogonal to the cylinder axis line C1. The upper part of the cylinder head 2 (the portion above the head middle surface 105) continuously covers its front, rear, left, and right areas, and is a hollow that is open upward leaving a head external wall 106, which is integral with a head body (see FIG. 7). The upper part of the cylinder head 2 houses the lower cam holder 41, which is fastened to the head middle surface 105 (each boss 104). The head external wall 106 is bulged upward (toward the head cover 3) from the head middle surface 105 so as to surround the front, rear, left, and right areas of the lower cam holder 41 fastened to the head middle surface 105 (see FIG. 7).

Figure 8:
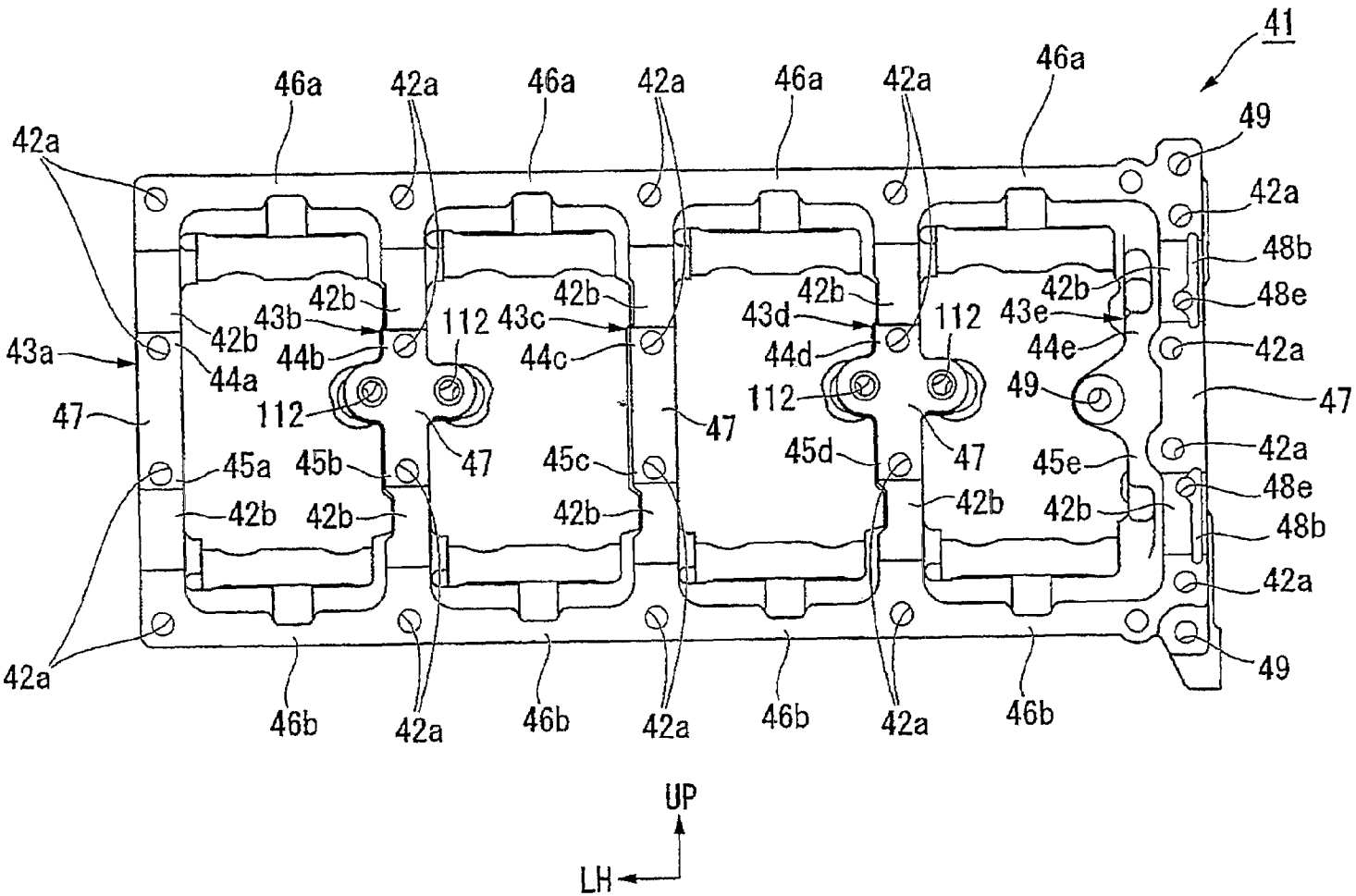
FIG. 8 is a top view illustrating a lower cam holder, which is fastened to the cylinder head.

Referring to FIGS. 5, 7, and 8, the lower cam holder 41 has a plurality of bolt insertion holes 42*a* that relate to the bosses 104. A plurality of bolts B1 or the like inserted into the bolt insertion holes 42*a* are used to fasten the lower cam holder 41 and the cam caps 51, 61, 71 to the cylinder head 2 in an integrated manner. Bolts B2 are fasten only to the lower cam holder 41 to the cylinder head 2 in the vicinity of the third cam cap 71. Bolt insertion holes 49 are provided into which the bolts B2 are to be inserted.

Referring to FIG. 5, the lower cam holder 41 is mounted on the cylinder head 2 with its underside abutted on and fitted onto the head middle surface 105 (the upper end face of each boss 104). In this state, the upper surface of the lower cam holder 41 is substantially flush with a joint surface (mating surface) 108 of the cylinder head 2 (the upper end face of the cylinder head 2) that mates with the head cover 3. The joint surface 108 is a flat surface that is orthogonal to the cylinder axis line C1 and is composed of the leading end (upper end) of the head external wall 106.

The base end (lower end) of an external wall 3*a* of the head cover 3, which is shaped like a cup and open downward, is abutted on and connected to the leading end of the head external wall 106 through a seal. In this state, a plurality of points of an upper wall of the head cover 3 are bolted down to the cam caps 51, 61, 71. This causes the head cover 3 to be simultaneously fastened to the cam caps 51, 61, 71 and to the cylinder head 2. In FIGS. 6 and 7, bosses 3*b* of the cam caps 51, 61, 71 are provided that are used for fastening to the head cover 3.

The upper surface of the lower cam holder 41 also functions as a joint surface 107 that mates with the lower surfaces of the cam caps 51, 61, 71. The central axis lines C3, C4 of the camshafts 11, 12 are on the joint surface 107.

Referring to FIGS. 1 and 5, the rocker arm shafts 14, 18 and the support shaft 32 are positioned below the upper end face (joint surfaces 107, 108) of the cylinder head 2, and supported by a plurality of cross walls 43*a* to 43*e* for the lower cam holder 41, which extend in the front-rear direction, while they are passed from side to side through the cross walls 43*a* to 43*e*. Support holes 14*a*, 18*a* and 32*a* are provided that are formed in the cross walls 43*a* to 43*e* to support the rocker arm shafts 14, 18 and support shaft 32.

The rocker arm shafts 14, 18, the support shaft 32, and the rocker arms 13, 17, trigger arm 33, and other component parts supported by the rocker arm shafts 14, 18 and support shaft 32 can now be attached to the cylinder head 2 together with the lower cam holder 41 while they are attached to the lower cam holder 41 in an integrated manner.

The head external wall 106 is extended to a position above the head middle surface 105 in such a manner so as to surround the rocker arm shafts 14, 18, support shaft 32, rocker arms 13, 17, trigger arm 33, and other mechanical component parts. The support holes 32*a* for the support shaft 32 of the lower cam holder 41 partially overlap with the bolt insertion holes 42*a* (see FIG. 5). A groove or other indentation for bypassing the bolts B1 is formed around the component parts inserted into the cross walls 43*a* to 43*e* of the support shaft 32, to prevent the bolts B1 from coming off.

Figure 10:
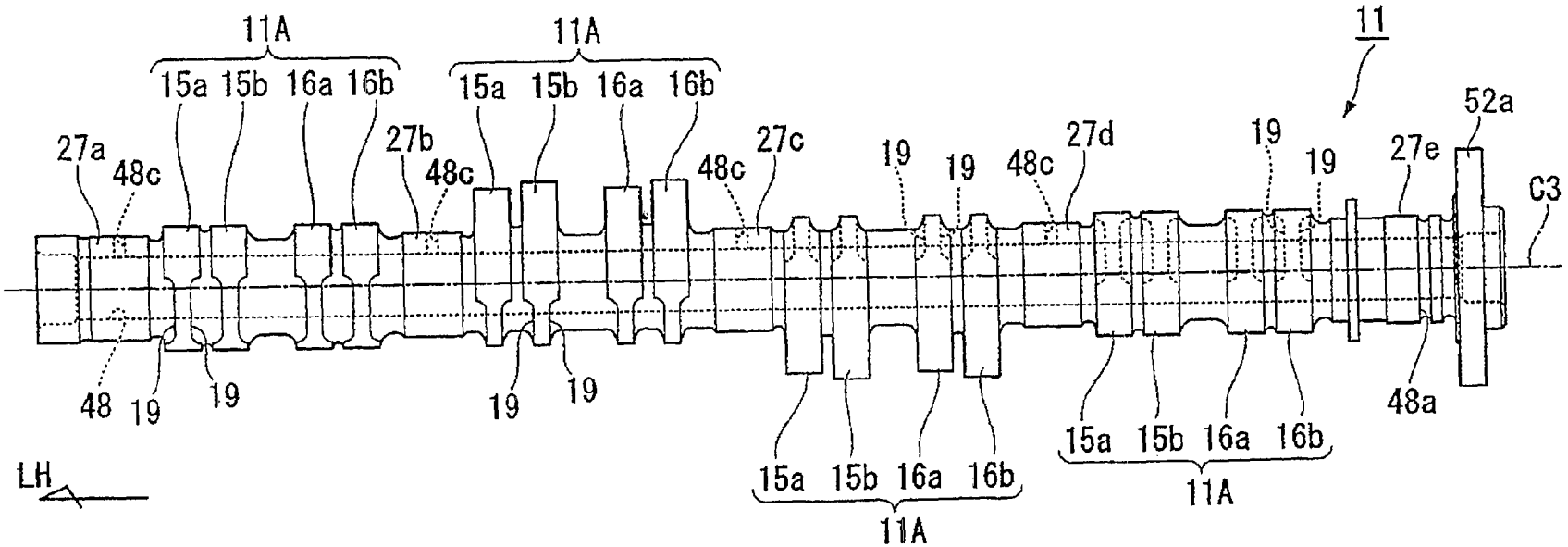
FIG. 10 is a plan view illustrating a camshaft of the engine.

The intake camshaft 11 will now be described with reference to FIG. 10. The exhaust camshaft 12 has the same configuration as the intake camshaft 11.

The camshaft 11 includes journal sections 27*a* to 27*e*, which are rotatably supported by the lower cam holder 41 and cam caps 51, 61, 71 and positioned on both sides of cam lobe formation sections having the left-hand and right-hand first cams 15*a*, 16*a* and left-hand and right-hand second earns 15*b*, 16*b* for one cylinder. From left to right, the journal sections 27*a* to 27*e* are sequentially referred to as the first to fifth journal sections.

The camshaft 11 has an inner hollow space that serves as an oil path.

Figure 9:
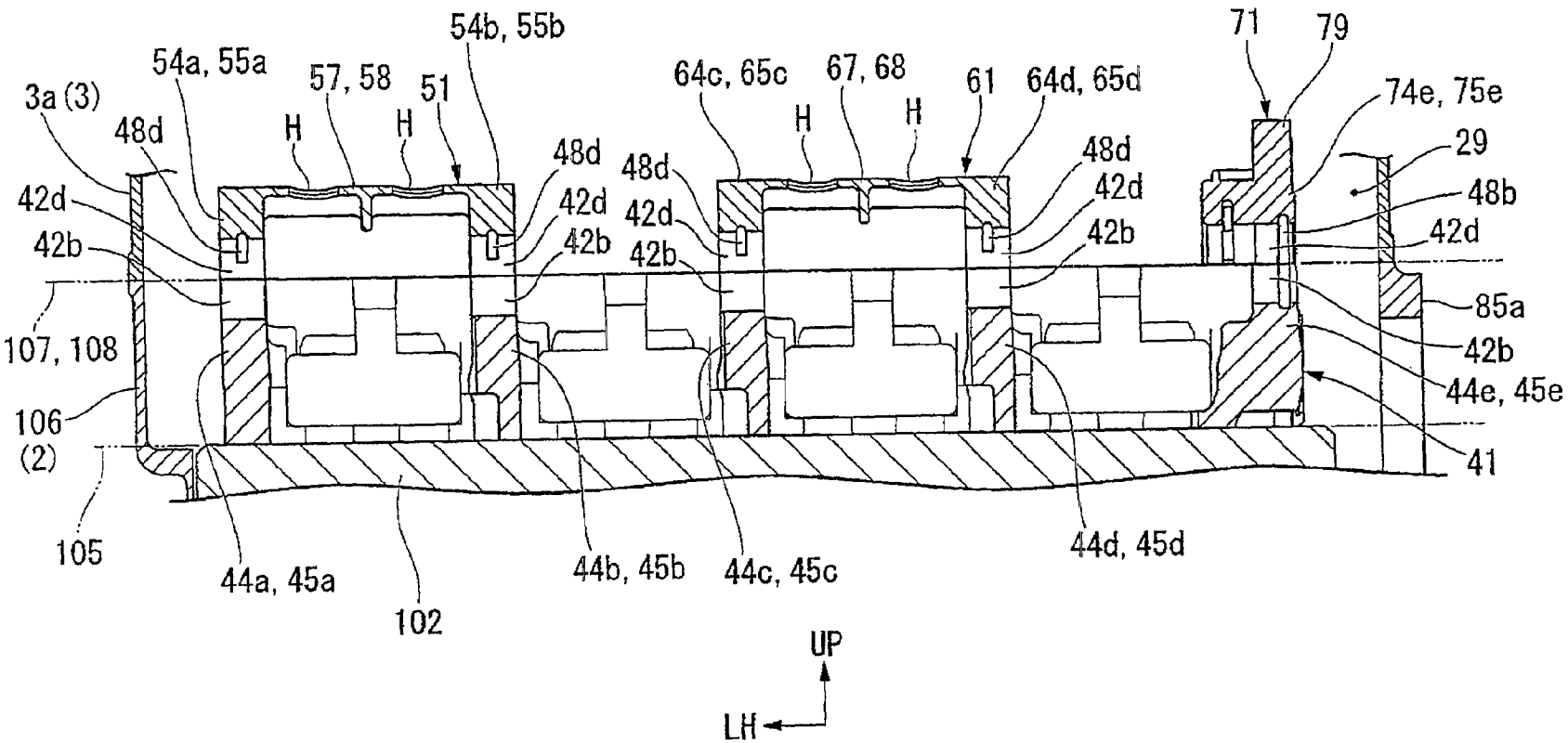
FIG. 9 is a cross-sectional view that is taken along a cam axis line of cam caps to illustrate the lower cam holder and the cam caps fastened to the lower cam holder.

Referring to FIGS. 8 and 9, the engine oil from the oil gallery 95 is supplied to the oil path 48 in the camshaft 11, for instance, through an oil groove 48*a* formed in the fifth journal section 27*e*, an oil groove 48*b* continuously formed in a concave 42*b* of a fifth lower cam holder section 44*e* and a concave 42*d* of a fifth cam cap 74*e*, and an oil path 48*e* continuously formed in the fifth lower cam holder section 44*e* and cylinder head 2.

Oil holes 48*c* are formed in the first to fourth journal sections 27*a* to 27*d*. Oil grooves 48*d* are formed in the concaves 42*d* of first to fourth cam cap sections 54*a*, 54*b*, 64*c*, 64*d*. The engine oil in the oil path 48 is supplied to sliding surfaces between the first to fourth journal sections 27*a* to 27*d* and the first to fourth lower cam holder sections 44*a* to 44*d* through the oil holes 48*c* and oil grooves 48*d*. The engine oil is also supplied to sliding surfaces between the fifth journal section 27*e* and the fifth lower cam holder section 44*e* through the oil grooves 48*a*, 48*b*.

Concaves 19 are formed on both sides of the reference surfaces of the cams 15*a*, 16*a*, 15*b*, 16*b*. The engine oil deposited in the concaves 19 is supplied between the cams 15*a*, 16*a*, 15*b*, 16*b* and the cam slide contact sections 13*c* of the rocker arm 13. Further, when the cams 15*a*, 16*a*, 15*b*, 16*b* rotate, the engine oil is splashed and supplied to the other lubrication points in the valve chamber 4. The engine oil supplied into the cylinder head 2 returns to the oil pan 91 through the cam chain chamber 29, which is positioned to the right of the cylinder. A cam driven sprocket 52*a* is provided in the chain-type transmission mechanism.

Referring to FIGS. 5 to 7, a plurality of bolt insertion holes 42*c*, which correspond to the bolt insertion holes 42*a* in the bosses 104 and lower cam holder 41, are formed in the cam caps 51, 61, 71. The cam caps 51, 61, 71 and the lower cam holder 41 are simultaneously fastened to the cylinder head 2 with the bolts B1 or the like inserted into the bolt insertion holes 42*c*.

Referring to FIG. 8, the lower cam holder 41 is mainly composed of the first to fifth cross walls 43*a* to 43*e*, which extend in the front-rear direction in a left-right position corresponding to the first to fifth journal sections of the camshafts 11, 12; a front coupling wall 46*a*, which joins the front ends of the cross walls 43*a* to 43*e*; and a rear coupling wall 46*b*, which joins the rear ends of the cross walls 43*a* to 43*e*. The first to fifth intake lower cam holder sections 44*a* to 44*e* are positioned behind the cross walls 43*a* to 43*e* to support the journal sections of the intake camshaft 11 from below. The first to fifth exhaust lower cam holder sections 45*a* to 45*e* are positioned before the cross walls 43*a* to 43*e* to support the journal sections of the exhaust camshaft 12 from below.

The lower cam holder sections 44*a* to 44*e*, 45*a* to 45*e* include concaves 42*b*, which match the lower halves of the corresponding journal sections and are semicircular in shape as viewed in an axial direction, and the bolt insertion holes 42*a*, which are positioned before and behind the concaves 42*b* (see FIGS. 5 and 6). The cross walls 43*a* to 43*e* join the intake lower cam holder sections 44*a* to 44*e* and associated exhaust lower cam holder sections 45*a* to 45*e* contiguously in an integrated manner via coupling sections 47, which are positioned between them. The front and rear ends of the cross walls 43*a* to 43*e* are positioned near the front and rear walls of the cylinder head 2. The front and rear coupling walls 46*a*, 46*b*, which join the front and rear ends of the cross walls 43*a* to 43*e*, are formed along the inner surfaces of the front and rear walls of the cylinder head 2 and extend from side to side in an integrated manner.

Referring to FIGS. 6 and 7, the first cam cap 51 includes first and second intake cam cap sections 54*a*, 54*b* and first and second exhaust cam cap sections 55*a*, 55*b*, which correspond to the first and second intake lower cam holder sections 44*a*, 44*b* and the first and second exhaust lower cam holder sections 45*a*, 45*b*. Each cam cap section includes a concave 42*d*, which matches the upper half of the associated journal section and is semicircular in shape as viewed in an axial direction, and the bolt insertion holes 42*c*, which are positioned before and behind the concave 42*d*.

Similarly, the second cam cap 61 includes third and fourth intake cam cap sections 64*c*, 64*d* and third and fourth exhaust cam cap sections 65*c*, 65*d*, which correspond to the third and fourth intake lower cam holder sections 44*c*, 44*d* and the third and fourth exhaust lower cam holder sections 45*c*, 45*d*. Each cam cap section includes a concave 42*d*, which matches the upper half of the associated journal section and is semicircular in shape as viewed in an axial direction, and the bolt insertion holes 42*c*, which are positioned before and behind the concave 42*d*.

In the first cam cap 51, the first intake cam cap section 54*a*, the first exhaust cam cap section 55*a*, the second intake cam cap section 54*b*, and the second exhaust cam cap section 55*b* are joined contiguously in an integrated manner via coupling sections 56, which are positioned between them. Further, the first and second intake cam cap sections 54*a*, 54*b* and the first and second exhaust cam cap sections 55*a*, 55*b* are joined in an integrated manner via front and rear headlining boards 57, 58, which are positioned between them.

Similarly, in the second cam cap 61, the third intake cam cap section 64*c*, the third exhaust cam cap section 65*c*, the fourth intake cam cap section 64*d*, and the fourth exhaust cam cap section 65*d* are joined contiguously in an integrated manner via coupling sections 66, which are positioned between them. Further, the third and fourth intake cam cap sections 64*c*, 64*d* and the third and fourth exhaust cam cap sections 65*c*, 65*d* are joined in an integrated manner via front and rear headlining boards 67, 68, which are positioned between them.

The third cam cap 71 includes a fifth intake cam cap section 74*e* and a fifth exhaust cam cap section 75*e*, which correspond to the fifth intake lower cam holder section 44*e* and the fifth exhaust lower cam holder section 45*e*. Each cam cap section 74*e*, 75*e* includes a concave 42*d*, which matches the upper half of the associated journal section and is semicircular in shape as viewed in an axial direction, and the bolt insertion holes 42*c*, which are positioned before and behind the concave 42*d*.

The fifth intake cam cap section 74*e* and the fifth exhaust cam cap section 75*e* are joined contiguously in an integrated manner via a coupling section 76, which is positioned between them. The reference numeral 79 denotes a boss for securing a cam chain guide (not shown).

Referring to FIGS. 5 to 7, the cam caps 51, 61, 71 are mounted from above onto the lower cam holder 41, which is placed at a predetermined position within the cylinder head 2. The cam cap sections are disposed above the lower cam holder sections. When, in this state, long bolts B1 are inserted into the bolt insertion holes 42*c* before and behind the cam caps and then into the bolt insertion holes 42*a* before and behind the lower cam holder sections, and the leading ends of the bolts B1 are screwed tight into screw holes in the bosses 104, the lower cam holder 41 and cam caps 51, 61, 71 are simultaneously fastened to the inside of the upper part of the cylinder head 2.

When, in the above state, the camshafts 11, 12 are sandwiched between the lower cam holder 41 and cam caps 51, 61, 71 with their journal sections retained between the lower cam holder sections and cam cap sections, the camshafts 11, 12 are rotatably journaled to the cam holder 41 and cam caps 51, 61, 71.

Referring to FIGS. 6, 7, and 9, in the first and second cam caps 51, 61, the headlining boards 57, 58, 67, 68 are curved concentrically with the associated camshafts in order to bypass the cams 11A, 12A of the camshafts 11, 12 positioned below and reduce the heights of the protrusions of the cam caps 51, 61, 71 toward the head cover 3. In other words, the headlining board surfaces facing the camshafts 11, 12 are concaved to bypass the cams 11A, 12A. Further, as the headlining boards are curved overall, adequate rigidity is obtained without limiting their arrangement. A short rib R is formed on the leading and trailing edges of each headlining board to enhance its overall strength and rigidity. In addition, a pair of left-hand and right-hand circular holes H are formed in the center of each headlining board to reduce the weight of the cam caps 51, 61, 71 and improve the maintainability and lubricity of the camshafts 11, 12.

The engine 1 includes a secondary air supply device 111, which adds secondary air to exhaust gas to promote its purification.

Referring to FIG. 5, the secondary air supply device 111 includes a secondary air supply path 112 and a valve compartment 113. The secondary air supply path 112 is formed for each cylinder and extends from the head cover 3 through the first and second cam caps 51, 61, the lower cam holder 41 to the cylinder head 2. The valve compartment 113 is formed on the head cover 3 to open the upper end of the secondary air supply path 112.

The lower part of the secondary air supply path 112 vertically extends at the front-rear intermediate portion of the cylinder head 2, in the vicinity of adjoining edges of the first and second cylinders, and in the vicinity of adjoining edges of the third and fourth cylinders. Further, the lowermost end of the lower part is open to an exhaust port 9 of the associated cylinder.

Referring also to FIG. 8, the up-down intermediate portion of the secondary air supply path 112 vertically extends on both the right-hand and left-hand sides of the lower cam holder's coupling section 47 between the first and second cylinders (the coupling section 47 between the second intake lower cam holder section 44*b* and the second exhaust lower cam holder section 45*b*) and on both the right-hand and left-hand sides of the lower cam holder's coupling section 47 between the third and fourth cylinders (the coupling section 47 between the fourth intake lower cam holder section 44*d* and the fourth exhaust lower cam holder section 45*d*), and vertically extends on both the right-hand and left-hand sides of the coupling section 56 between the second intake cam cap section 54*b* and the second exhaust cam cap section 55*b* of the first cam cap 51 and on both the right-hand and left-hand sides of the coupling section 66 between the fourth intake cam cap section 64*d* and the fourth exhaust cam cap section 65*d* of the second cam cap 61. In the lower cam holder 41, the lower part of the secondary air supply path 112 is shifted so that it projects from the coupling section 47 to a greater extent than the upper part.

Referring also to FIGS. 6 and 7, the upper part of the secondary air supply path 112 vertically extends at the front-rear intermediate portion of the head cover 3, in the vicinity of adjoining edges of the first and second cylinders, and in the vicinity of adjoining edges of the third and fourth cylinders. Further, the uppermost end of the upper part is open to the lower part of the valve compartment 113, which is mounted on the head cover 3 in a protruding manner.

Referring to FIG. 5, a pair of right-hand and left-hand units of the valve compartment 113, for example, are positioned before the upper wall of the head cover 3 and substantially directly above the secondary air supply path 112. The space within the valve compartment 113 is separated airtight from the space within the valve chamber 4. A communication nozzle 113*a* is mounted on the top of the valve compartment 113 in a protruding manner such that the inside thereof communicates with a clean side of an air cleaner (not shown).

A laminar reed valve 114 is installed in the valve compartment 113. The reed valve 114 zones the space within the valve compartment 113 into an upper space, which is on the side toward the communication nozzle 113*a*, and a lower space, which is on the side toward the secondary air supply path 112.

When an atmospheric or higher pressure is present in the exhaust port 9, the reed valve 114 breaks the communication between the communication nozzle 113*a* and the secondary air supply path 112. When, on the other hand, a negative pressure is developed in the exhaust port 9, the reed valve 114 establishes the communication between the communication nozzle 113*a* and the secondary air supply path 112. This makes it possible to add the secondary air to the exhaust gas in the exhaust port 9 in accordance with an exhaust stroke of the engine 1. A breather chamber 115 is provided that is installed behind the upper wall of the head cover 3 in a protruding manner.

Figure 14:
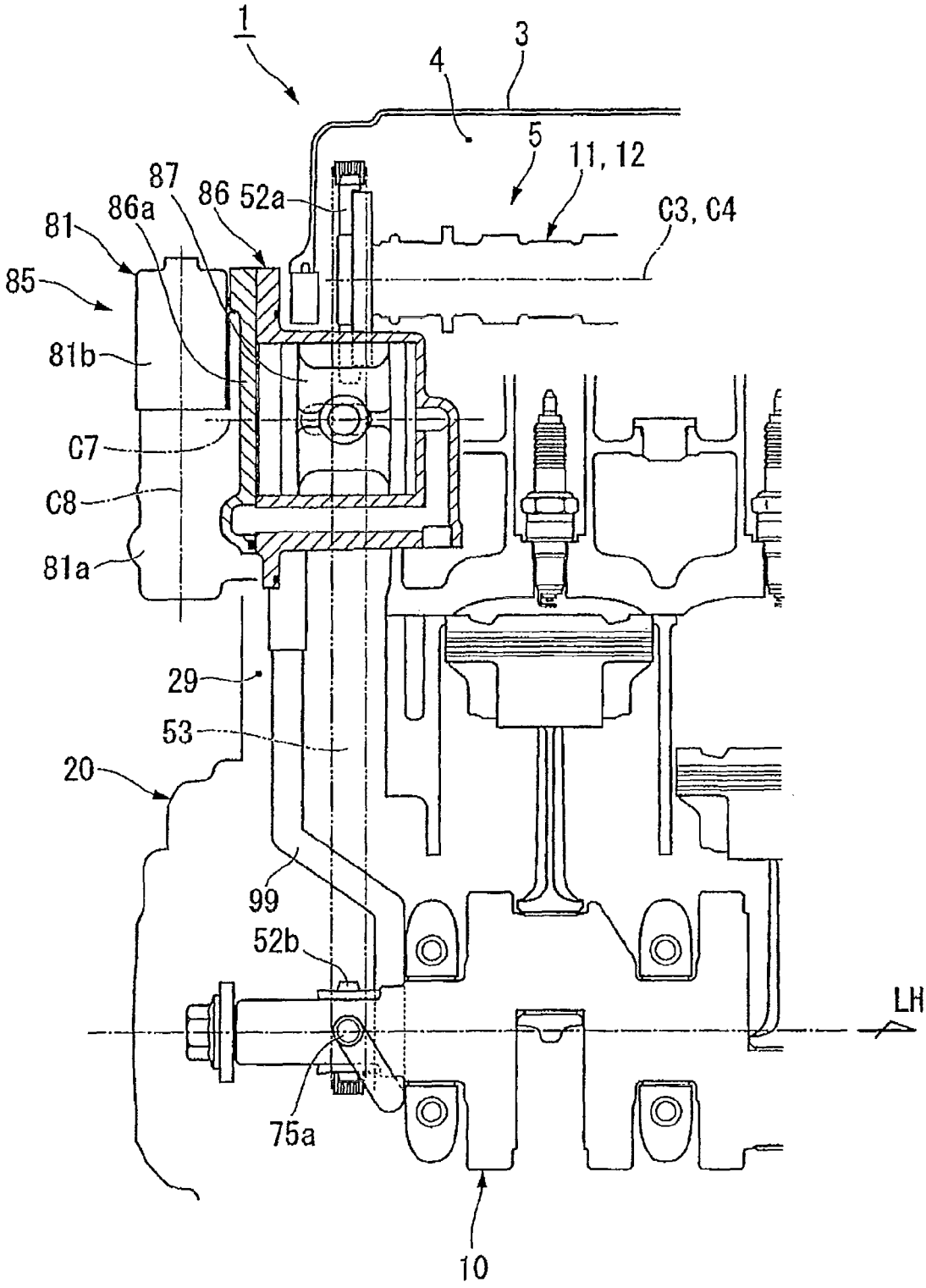
FIG. 14 is a plane cross-sectional view that is taken from the front of the cylinder section and from the bottom of a crankshaft section.

Referring to FIGS. 13 and 14, the cam driven sprocket 52*a* having a relatively large diameter is mounted coaxially on the leftmost end of each camshaft 11, 12 so that the cam driven sprocket 52*a* rotates together with each camshaft 11, 12. A cam drive sprocket 52*b* having a relatively small diameter is mounted coaxially on the left side of the crankshaft 10 so that the cam drive sprocket 52*b* rotates together with the crankshaft 10. An endless cam chain 53 is wound around the sprockets 52*a*, 52*b*. The sprockets 52*a*, 52*b* and cam chain 53 constitute the chain-type transmission mechanism, which rotationally drives the camshafts 11, 12 in synchronism with the crankshaft 10.

A cam chain guide 53*a* is provided which is positioned before the cam chain chamber 29, slidingly contacts the tight side of the cam chain 53 from the front (peripheral side), and guides the cam chain 53 in the direction of its movement. A tensioner arm 53*b* (cam chain tensioner), is positioned behind the cam chain chamber 29, slidingly contacts the slack side of the cam chain 53 from the rear (peripheral side), guides the cam chain 53 in the direction of its movement, and applies proper tension to (removes slack from) the cam chain 53. An oil path 99 extends from the oil supply hole 95*a* to the hydraulic actuator 85.

The right-hand portion of the cylinder head 2, which the rightmost end of each rocker arm shaft 14, 18 faces, includes the hydraulic actuator 85, which moves each rocker arm shaft 14, 18 in the direction of axis C5.

Figure 12:
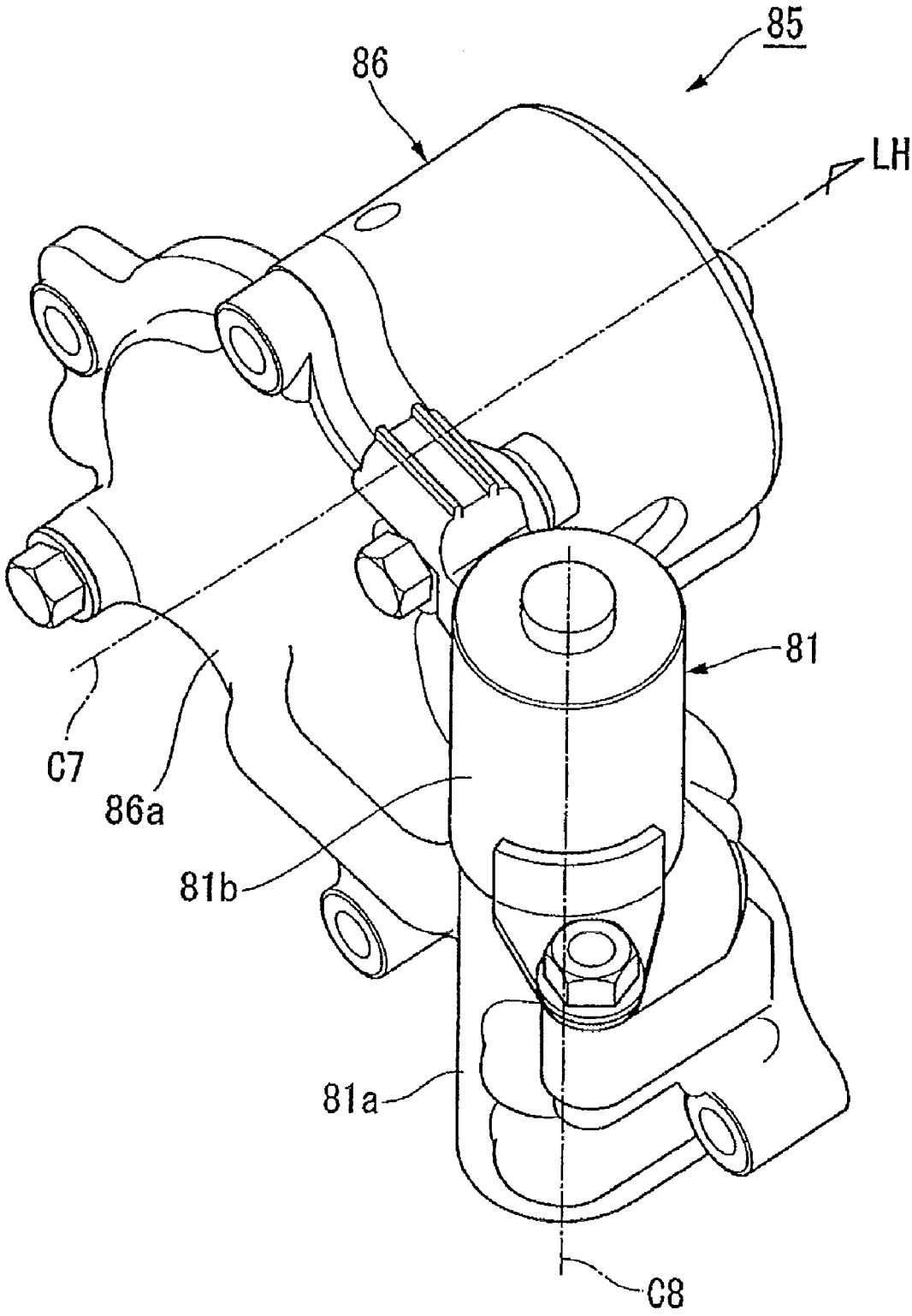
FIG. 12 is a perspective view illustrating a hydraulic actuator which moves the rocker arm shaft in the axial direction.
Figure 15:
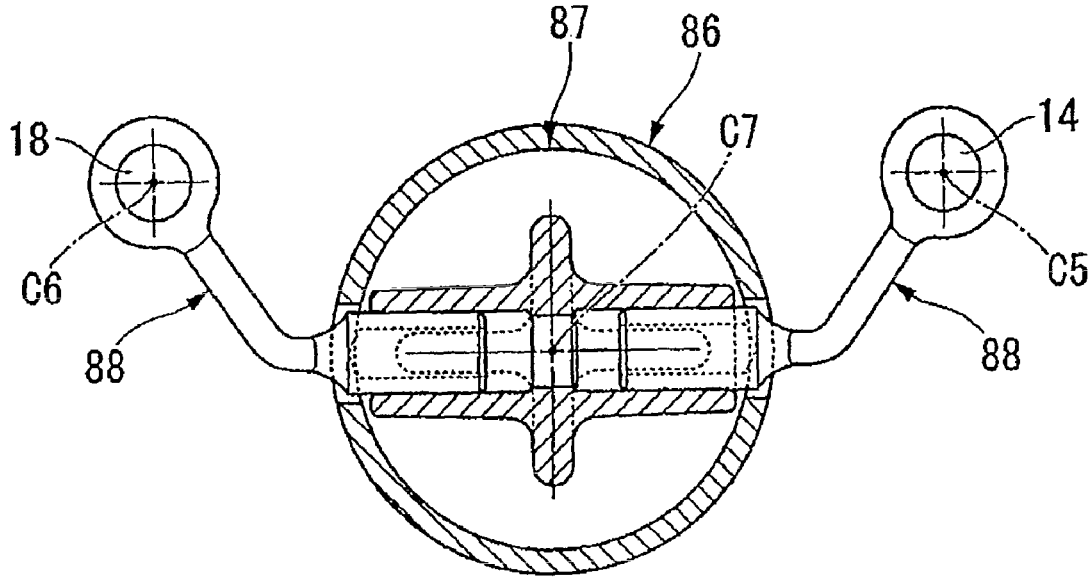
FIG. 15 is a cross-sectional view illustrating a hydraulic cylinder for the hydraulic actuator.

Referring to FIGS. 12 and 15, the hydraulic actuator 85 is configured so that the hydraulic cylinder 86 whose axial direction is parallel to that of the rocker arm shafts 14, 18 is positioned so as to transversely cross the cam chain chamber 29 in the right-hand portion of the cylinder head 2 between the rocker arm shafts 14, 18. The pair of front and rear operating elements 88 are attached to both lateral surfaces of the plunger 87 in the hydraulic cylinder 86. The operating elements 88 respectively engage with the rightmost ends of the rocker arm shafts 14, 18 so that the rocker arm shafts 14, 18 simultaneously move in the direction of axis C5 in accordance with a stroke of the plunger 87.

The hydraulic actuator 85 includes the bottomed cylindrical hydraulic cylinder 86, the plunger 87 which is coaxially housed in the hydraulic cylinder 86 and allowed to stroke, a plate-like cover 86*a* for covering the open end of the hydraulic cylinder 86, and the spool valve 81 which is attached to one side of the cover 86*a* in an integrated manner.

The periphery of the cover 86*a* is bolted or otherwise fastened to the periphery of the mount 85*a* on the right-hand portion of the cylinder head 2 together with a flange formed on the open end of the hydraulic cylinder 86. The greater part of the hydraulic cylinder 86 is then inserted into the cylinder head 2 to prevent the hydraulic cylinder 86 from projecting out of the cylinder head 2 (out of the engine).

The hydraulic cylinder 86 is positioned so that the center of its axis (axis line C7) is close to the cylinder axis line C2 in a side view of the engine. Meanwhile, the spool valve 81 has the appearance of a vertically extending cylinder and is positioned so that the center of its axis (axis line C8) is perpendicular to the axis line C7 of the hydraulic cylinder 86 and substantially parallel to the cylinder axis line C2.

A casing 81*a*, which forms the bottom of the spool valve 81, is formed on one side of the cover 86*a* in an integrated manner. The plunger 87, which is capable of switching from one hydraulic path to another, is housed in the casing 81*a* and allowed to stroke. The top of the spool valve 81 is composed of a solenoid 81*b*, which causes the plunger 87 to stroke and change the hydraulic path.

The spool valve 81 is positioned before and clear of the hydraulic cylinder 86 in a side view of the engine (as viewed in an axial direction of the hydraulic cylinder 86). This prevents the spool valve 81 from projecting out of the cylinder head 2 (out of the engine).

The hydraulic actuator 85 is positioned between the upper and lower ends of the cylinder head 2. More specifically, in a side view of the engine, the hydraulic actuator 85 is positioned between the upper end face (the lateral end face of the head cover 3 and the joint surface 108) of the cylinder head 2 and the lower end face (the lateral end face of the cylinder body 2*a* and the joint surface 109). The joint surfaces 108, 109 are shaped like a plane perpendicular to the cylinder axis line C1. The hydraulic actuator 85 is mounted on the right-hand portion of the cylinder head 2 in such a manner that it lies between the joint surfaces 108, 109 in a vertical direction along the cylinder axis line C1 and vertically straddles the head middle surface 105 in a side view. Consequently, the hydraulic actuator 85 is positioned so that its bottom is positioned below the head middle surface 105 and is mounted on the right side wall of the cylinder head 2. The top of the hydraulic actuator 85 is positioned above the head middle surface 105 and is mounted on the head external wall 106.

As described above, the fixation structure according to the embodiment described above, which is used for a valve system rotation shaft of the engine 1, rotatably fixes the camshafts 11, 12 for driving the intake and exhaust valves 6, 7 mounted on the cylinder head 2 of the engine 1 to the cylinder head 2 through the use of the lower cam holder 41 and the cam caps 51, 61, 71. The fixation structure also fixes the lower cam holder 41, which is formed separately from the cylinder head 2, to the cylinder head 2. The head middle surface 105, which serves as a holder fixation section for securing the lower cam holder, and the head external wall 106, which serves as a cover connection section for connecting the base end of the external wall 3*a* of a head cover 3 at the peripheral side of the head middle surface 105, are provided on the side toward the head cover 3 of the cylinder head 2. The head external wall 106 extends toward the head cover 3 rather than toward the head middle surface 105 in such a manner so as to cover the circumference of the lower cam holder 41 fixed to the head middle surface 105. The connection to the holder fixation section is established with the base end of the external wall 3*a* of the head cover 3 abutted on the leading end of the head external wall 106.

The use of the above configuration makes it possible to extend the head external wall 106 for securing the head cover 3 toward the head cover 3 with respect to the head middle surface 105 for securing the lower cam holder 41, which is separate from the cylinder head 2, and to establish the connection to the holder fixation section with the base end of the external wall 3*a* of the head cover 3 abutted on the leading end of the head external wall 106, thereby eliminating the necessity of extending the external wall 3*a* of the head cover 3 to minimize its depth and then covering the circumferences, for instance, of the lower cam holder 41, which is fixed to the head middle surface 105, and of the cam caps 51, 61, 71, which are fixed to the lower cam holder 41. Consequently, it is possible to eliminate the necessity of taking special vibration/noise control measures for the head cover 3, such as increasing its thickness and providing an additional reinforcement to prevent an increase in the cost, size, and weight of the head cover 3. Further, as the depth of the head cover 3 is decreased, the head cover 3 can be removed and reinstalled for maintenance purposes even when the engine 1 is mounted in the vehicle. This provides improved maintainability.

Further, the fixation structure for the valve system rotation shaft of the engine 1 can be configured so that the central axis lines C3, C4 of the camshafts 11, 12 are positioned on the joint surface 107 between the lower cam holder 41 and the cam caps 51, 61, 71. The joint surface 107 can be substantially flush with the joint surface 108 between the head external wall 106 and the external wall 3*a* of the head cover 3. Therefore, when the camshafts 11, 12 are to be installed, it is easy to verify that the camshafts 11, 12 are properly set on the lower cam holder 41. This provides improved assembly workability of the camshafts 11, 12.

Furthermore, the fixation structure for the valve system rotation shaft of the engine 1 can be configured so that the lower cam holder 41 is fastened to the cylinder head 2 together with the cam caps 51, 61, 71 through the use of the bolts B1 that are shared by the lower cam holder 41 and the cam caps 51, 61, 71. This makes it possible to decrease the number of dedicated fasteners for fastening the lower cam holder 41 only, thereby reducing the cost and weight.

Moreover, the fixation structure for the valve system rotation shaft of the engine 1 can be configured so that the lower cam holder 41 is provided with the support holes 14*a*, 18*a* for supporting the rocker arm shafts 14, 18, which swingably support the rocker arms 13, 17 swung by the camshafts 11, 12. In addition, the head external wall 106 extends upward beyond the support holes 14*a*, 18*a*. As far as the rocker arm shafts 14, 18 are supported by the support holes 14*a*, 18*a* in the lower cam holder 41, the rocker arm shafts 14, 18 and the rocker arms 13, 17 can be mounted on the cylinder head 2 while they are attached to the lower cam holder 41, even if the employed configuration is such that the rocker arm shafts 14, 18 are positioned below the leading end of the head external wall 106. Consequently, the rocker arm shafts 14, 18 can be placed in the space below the camshaft support position without sacrificing the assembly workability of the rocker arm 13, 17. This makes it possible to minimize the height of the cylinder head 2.

In addition, the fixation structure for the valve system rotation shaft of the engine 1 can be configured so that the lower cam holder 41 includes at least a part of the secondary air supply path 112 between the secondary air supply reed valve 114 mounted on the head cover 3 and the exhaust port 9 of the cylinder head 2. In this instance, the lower cam holder 41 can be used to provide the secondary air supply path 112. This makes it possible to reduce the cost and weight by reducing the number of dedicated parts.

In addition, the fixation structure for the valve system rotation shaft of the engine 1 can also be applied to a parallel multicylinder engine. When the lower cam holder 41 is formed by coupling the lower cam holder sections 44*a* to 44*e*, 45*a* to 45*e* of neighboring cylinders in an integrated manner, the lower cam holder sections for a plurality of cylinders can be formed in an integrated manner. This provides improved productivity and assembly workability.

Further, the fixation structure for the valve system rotation shaft of the engine 1 is configured so that the hydraulic actuator 85 for driving the valve device 5 straddles the head external wall 106 of the cylinder head 2 in such a manner so as to lie between the head cover 3 side end (joint surface 108) of the head external wall 106 (cover connection section) of the cylinder head 2 and the cylinder side end (joint surface 109) forming the mating surface of the cylinder head 2 that is to be connected to the cylinder body 2*a*.

The use of the above configuration enables the engine 1 having the hydraulic actuator 85 to provide the cylinder head 2 with an adequate space for installing the hydraulic actuator 85 as far as the hydraulic actuator 85 for driving the valve device 5 is installed to straddle the head external wall 106, which extends towards the head cover 3. If, as in a previous case, a deep head cover 3 is formed with a small cylinder head 2 side portion, it was difficult to provide the cylinder head 2 with a space for installing the hydraulic actuator 85 so that the hydraulic actuator 85 had to be mounted on the head cover 3 or installed to straddle the cylinder body 2*a* or crankcase 20. However, when the hydraulic actuator 85 is installed to straddle the head external wall 106, which extends toward the head cover 3, the above-described configuration makes it possible to position the hydraulic actuator 85 near the valve device 5 to be driven, thereby improving the operability and response of the valve device 5.

It is to be understood that the present invention is not limited to the above-described embodiment. For example, the present invention can also be applied to an engine that includes a normal valve system without a variable valve timing mechanism, an SOHC engine whose cylinder head includes a single camshaft, and an engine configured so that at least some valves are directly driven by a camshaft without using a rocker arm.

Further, the present invention is also applicable to a parallel multicylinder engine other than a four-cylinder engine, a V-type, horizontally-opposed, or other similar multicylinder engine, a single-cylinder engine, a longitudinal engine whose crankshaft extends in the front-rear direction of the vehicle, and various other types of reciprocating engines.

Figure 11:
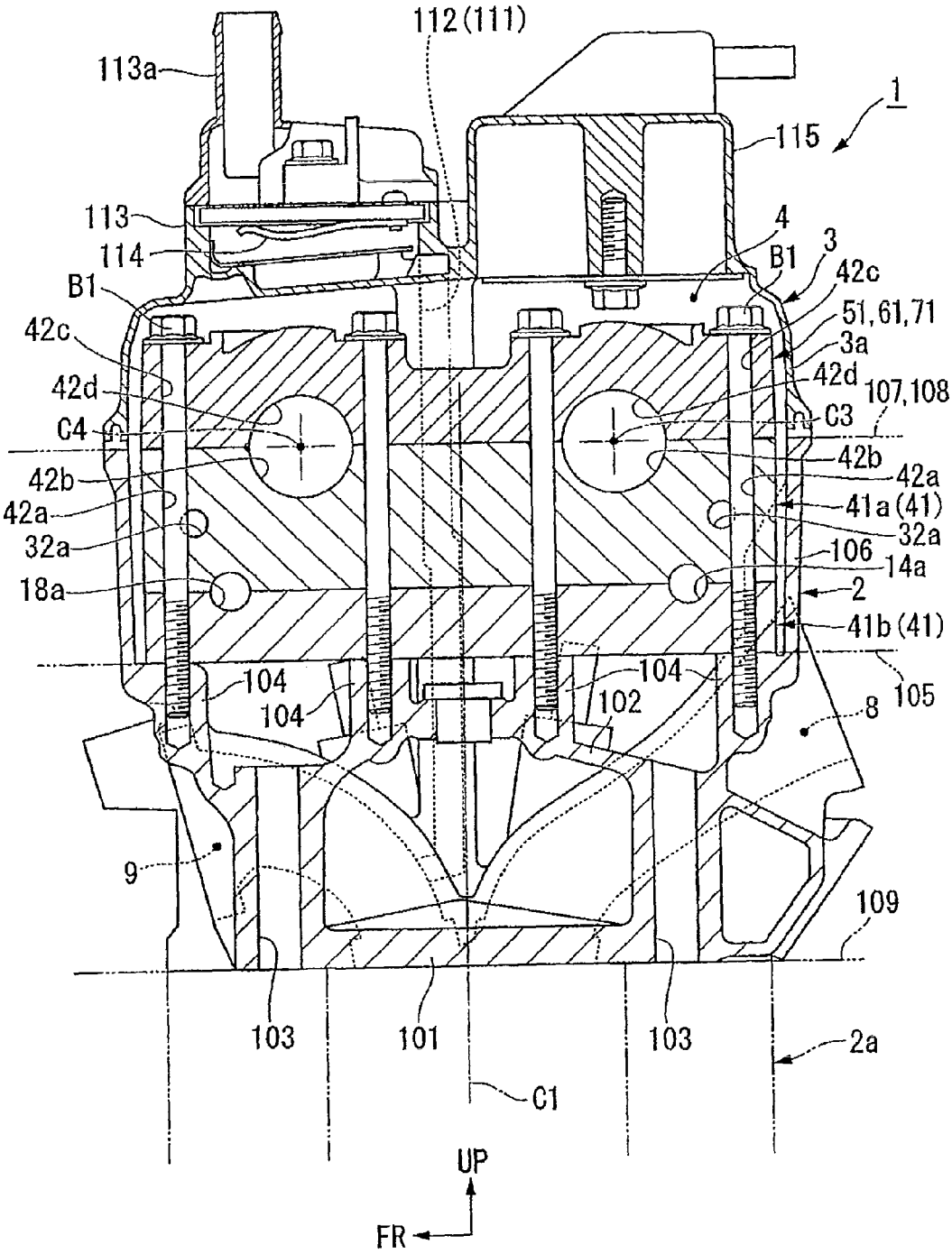
FIG. 11 is a cross-sectional view that corresponds to FIG. 5 and illustrates an alternative embodiment of the present invention.

Furthermore, as shown in FIG. 11, the lower cam holder 41 can be divided into upper and lower halves 41*a*, 41*b* at the central position of the support holes 14*a*, 18*a* for the rocker arm shafts 14, 18 (with the support member for the camshafts 11, 12, rocker arm shafts 14, 18, and support shaft 32 separated into three sections). This makes it possible to install and remove the three different types of shafts (camshafts 11, 12, rocker arm shafts 14, 18, and support shaft 32) on an individual basis. As a result, assembly workability and maintainability will be improved.

While the embodiments described above are presently preferred, it should be understood that they are offered by way of example only. Persons of skill in the art will appreciate that variations may be made without departure from the scope and spirit of the invention. For example, the accumulator 84*a* shown in FIG. 2 need not always be used. Further, the computational load can be reduced by exercising simplified control without using the gear position, PB, and oil temperature detected by the ECU.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fixation structure for a valve system rotation shaft of an internal combustion engine, the fixation structure being designed to rotatably fix a camshaft for driving an engine valve mounted on a cylinder head of the internal combustion engine to the cylinder head through the use of a lower cam holder and a cam cap, and to fix the lower cam holder, which is formed separately from the cylinder head, to the cylinder head, comprising:

a holder fixation section formed in the cylinder head for securing the lower cam holder; and a cover connection section for connecting a base end of an external wall of a head cover at the peripheral side of the holder fixation section;

said cover connection section extends toward the head cover rather than toward the holder fixation section in a manner so as to cover the circumference of the lower cam holder fixed to the holder fixation section; and a connection to the holder fixation section is established with the base end of the external wall of the head cover abutted on a leading end of the cover connection section.

2. The fixation structure for the valve system rotation shaft of the internal combustion engine according to claim 1, wherein:

the central axis line of the camshaft is positioned on a joint surface between the lower cam holder and the cam cap; and the joint surface is substantially flush with a joint surface between the cover connection section and the external wall of the head cover.

3. The fixation structure for the valve system rotation shaft of the internal combustion engine according to claim 2, wherein the lower cam holder is fastened to the cylinder head together with the cam cap through the use of a fastener shared by the lower cam holder and the cam cap.

4. The fixation structure for the valve system rotation shaft of the internal combustion engine according to claim 2, wherein:

the lower cam holder is provided with a support hole for supporting a rocker arm shaft, the rocker arm shaft swingably supporting a rocker arm swung by the camshaft; and the cover connection section extends upward beyond the support hole.

5. The fixation structure for the valve system rotation shaft of the internal combustion engine according to claim 2, wherein the lower cam holder includes at least a part of a secondary air supply path between a secondary air supply valve mounted on the head cover and an exhaust port of the cylinder head.

6. The fixation structure for the valve system rotation shaft of the internal combustion engine according to claim 2, wherein:

the internal combustion engine is a parallel multicylinder engine and the lower cam holder is formed by coupling lower cam holder sections of neighboring cylinders in an integrated manner.

7. The fixation structure for the valve system rotation shaft of the internal combustion engine according to claim 2, wherein an actuator for driving the valve system is installed to straddle the cover connection section of the cylinder head and is positioned between a head cover side end of the cover connection section of the cylinder head and a cylinder side end forming a mating surface to be connected to a cylinder block of the cylinder head.

8. The fixation structure for the valve system rotation shaft of the internal combustion engine according to claim 1, wherein the lower cam holder is fastened to the cylinder head together with the cam cap through the use of a fastener shared by the lower cam holder and the cam cap.

9. The fixation structure for the valve system rotation shaft of the internal combustion engine according to claim 8, wherein:

the lower cam holder is provided with a support hole for supporting a rocker arm shaft, the rocker arm shaft swingably supporting a rocker arm swung by the camshaft; and the cover connection section extends upward beyond the support hole.

10. The fixation structure for the valve system rotation shaft of the internal combustion engine according to claim 8, wherein the lower cam holder includes at least a part of a secondary air supply path between a secondary air supply valve mounted on the head cover and an exhaust port of the cylinder head.

11. The fixation structure for the valve system rotation shaft of the internal combustion engine according to claim 8, wherein:

the internal combustion engine is a parallel multicylinder engine and the lower cam holder is formed by coupling lower cam holder sections of neighboring cylinders in an integrated manner.

12. The fixation structure for the valve system rotation shaft of the internal combustion engine according to claim 1, wherein:

the lower cam holder is provided with a support hole for supporting a rocker arm shaft, the rocker arm shaft swingably supporting a rocker arm swung by the camshaft; and the cover connection section extends upward beyond the support hole.

13. The fixation structure for the valve system rotation shaft of the internal combustion engine according to claim 12, wherein the lower cam holder includes at least a part of a secondary air supply path between a secondary air supply valve mounted on the head cover and an exhaust port of the cylinder head.

14. The fixation structure for the valve system rotation shaft of the internal combustion engine according to claim 1, wherein the lower cam holder includes at least a part of a secondary air supply path between a secondary air supply valve mounted on the head cover and an exhaust port of the cylinder head.

15. The fixation structure for the valve system rotation shaft of the internal combustion engine according to claim 1, wherein:

the internal combustion engine is a parallel multicylinder engine and the lower cam holder is formed by coupling lower cam holder sections of neighboring cylinders in an integrated manner.

16. The fixation structure for the valve system rotation shaft of the internal combustion engine according to claim 1, wherein an actuator for driving the valve system is installed to straddle the cover connection section of the cylinder head and is positioned between a head cover side end of the cover connection section of the cylinder head and a cylinder side end forming a mating surface to be connected to a cylinder block of the cylinder head.

17. A fixation structure for a valve system rotation shaft of an internal combustion engine, comprising:

a camshaft rotatably mounted relative to the fixation structure;

an engine valve mounted relative to a cylinder head of the internal combustion engine, said engine valve being driven by said camshaft;

a lower cam holder and a cam cap for mounting the engine valve relative to the cylinder head;

said lower cam holder being formed separately from the cylinder head and being secured relative to the cylinder head;

a holder fixation section formed in the cylinder head for securing the lower cam holder;

a cover connection section for connecting a base end of an external wall of a head cover at the peripheral side of the holder fixation section;

said cover connection section extending toward the head cover rather than toward the holder fixation section for covering the circumference of the lower cam holder fixed to the holder fixation section; and a connection to the holder fixation section being established with the base end of the external wall of the head cover abutted on a leading end of the cover connection section.

18. The fixation structure for the valve system rotation shaft of the internal combustion engine according to claim 17, wherein:

the central axis line of the camshaft is positioned on a joint surface between the lower cam holder and the cam cap; and the joint surface is substantially flush with a joint surface between the cover connection section and the external wall of the head cover.

19. The fixation structure for the valve system rotation shaft of the internal combustion engine according to claim 17, wherein the lower cam holder is fastened to the cylinder head together with the cam cap through the use of a fastener shared by the lower cam holder and the cam cap.

20. The fixation structure for the valve system rotation shaft of the internal combustion engine according to claim 17, wherein:

the lower cam holder is provided with a support hole for supporting a rocker arm shaft, the rocker arm shaft swingably supporting a rocker arm swung by the camshaft; and the cover connection section extends upward beyond the support hole.

* * * * *